US010855015B2

(12) United States Patent
Kufner et al.

(10) Patent No.: US 10,855,015 B2
(45) Date of Patent: Dec. 1, 2020

(54) CONTACT ELEMENT

(71) Applicant: STAUBLI ELECTRICAL CONNECTORS AG, Allschwil (CH)

(72) Inventors: Tom Kufner, Riehen (CH); Philipp Alexander Strehler, Basel (CH); Fabian Hilti, Ziefen (CH); Lucas Wirz, Basel (CH)

(73) Assignee: STAUBLI ELECTRICAL CONNECTORS AG, Allschwil (CH)

( * ) Notice: Subject to any disclaimer, the term of this patent is extended or adjusted under 35 U.S.C. 154(b) by 0 days.

(21) Appl. No.: 16/303,240

(22) PCT Filed: May 19, 2017

(86) PCT No.: PCT/EP2017/062066
§ 371 (c)(1),
(2) Date: Nov. 20, 2018

(87) PCT Pub. No.: WO2017/202708
PCT Pub. Date: Nov. 30, 2017

(65) Prior Publication Data

US 2019/0207338 A1 Jul. 4, 2019

(30) Foreign Application Priority Data

May 25, 2016 (EP) ..... 16171340
May 25, 2016 (EP) ..... 16171341
May 25, 2016 (EP) ..... 16171346

(51) Int. Cl.
*H01R 13/24* (2006.01)
*H01R 4/48* (2006.01)
*H01R 43/00* (2006.01)

(52) U.S. Cl.
CPC ..... *H01R 13/24* (2013.01); *H01R 4/4881* (2013.01); *H01R 13/2457* (2013.01); *H01R 13/2492* (2013.01); *H01R 43/007* (2013.01)

(58) Field of Classification Search
CPC ..... H01R 13/052; H01R 13/187; H01R 4/48; H01R 4/52
(Continued)

(56) References Cited

U.S. PATENT DOCUMENTS 6,062,919 A * 5/2000 Trafton ..... H01R 13/187 439/843
6,547,607 B2 * 4/2003 Moll ..... H01R 13/187 439/816
(Continued)

FOREIGN PATENT DOCUMENTS

CN 104600456 A 5/2015
DE 3014118 A 2/1981
(Continued)

OTHER PUBLICATIONS

Communication dated Oct. 25, 2016 from the European Patent Office in application No. 16171340.9.
(Continued)

*Primary Examiner* — Hien D Vu
(74) *Attorney, Agent, or Firm* — Sughrue Mion, PLLC

(57) ABSTRACT

A contact element (1) for establishing electric contact between two contact pieces (K1, K2) comprises a support strip (2), which extends in a longitudinal direction (L) and is designed in such a way that the length of the support strip (2) changes in the longitudinal direction (L) when a force (F) is applied to the support strip (2), as well as a plurality of contact parts (5, 5*a*, 5*b*), each of which has a first contact section (6) for contacting one of the two contact pieces (K1, K2), a second contact section (7) for contacting the other one
(Continued)

of the two contact pieces (K2, K1), and a fastening section (8) for securing the contact part (5, 5*a,* 5*b*) to the support strip (2).

25 Claims, 21 Drawing Sheets

(58) Field of Classification Search
USPC ..... 439/843, 845, 827
See application file for complete search history.

(56) References Cited

U.S. PATENT DOCUMENTS

| | | | | |
|---|---|---|---|---|
| 6,783,406 | B2 * | 8/2004 | Keiser | H01R 4/4881 439/827 |
| 7,078,614 | B1 | 7/2006 | Van Haaster | |
| 8,057,269 | B2 * | 11/2011 | Ledermann | H01R 13/187 439/827 |
| 8,821,170 | B1 | 9/2014 | Thein et al. | |
| 10,135,180 | B2 * | 11/2018 | Sturgess | H01R 4/4881 |
| 2001/0019923 | A1 | 9/2001 | Moll et al. | |
| 2010/0093230 | A1 | 4/2010 | Ledermann et al. | |

FOREIGN PATENT DOCUMENTS

| | | | |
|---|---|---|---|
| EP | 0 716 474 | A1 | 6/1996 |
| EP | 1 119 077 | A1 | 7/2001 |
| EP | 2115820 | | 11/2009 |
| EP | 2693573 | A2 | 2/2014 |
| GB | 2398680 | A | 8/2004 |
| WO | 2008/092284 | A1 | 8/2008 |

OTHER PUBLICATIONS

International Search Report for PCT/EP 2017/062066 dated Jul. 14, 2017 (PCT/ISA/210).

* cited by examiner

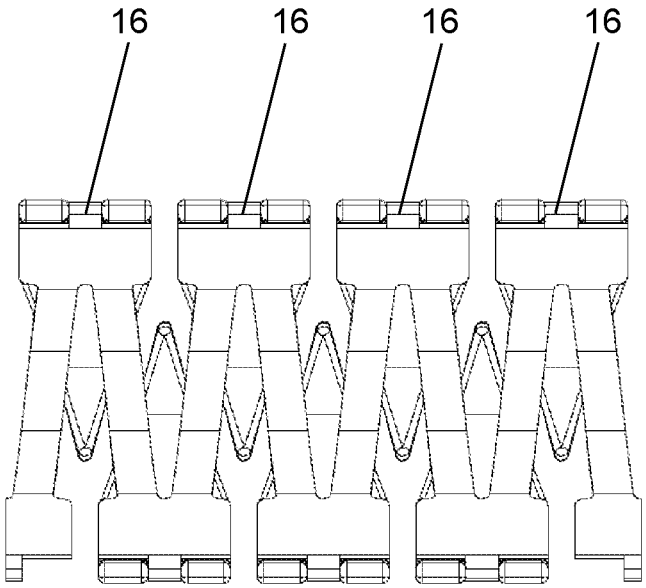
FIG. 8b
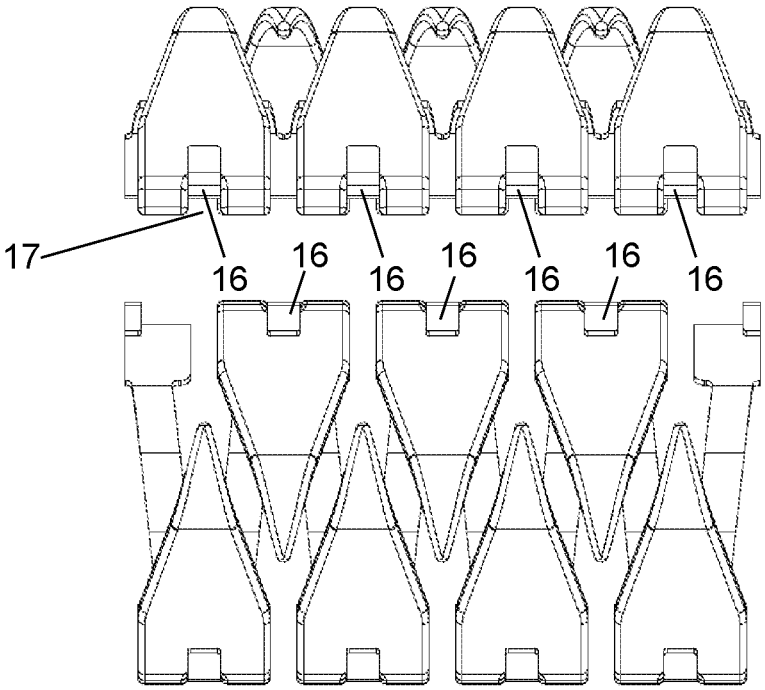
FIG. 8c
FIG. 8d

CONTACT ELEMENT

CROSS REFERENCE TO RELATED APPLICATIONS

This application is a National Stage of International Application No. PCT/EP2017/062066 filed May 19, 2017, claiming priorities based on European Patent Application Nos. 16171346.6, 16171341.7 and 16171340.9 filed May 25, 2016, the disclosure of which is incorporated herein in its entirety by reference.

TECHNICAL FIELD

The present invention relates to a contact element for establishing electrical contact between two contact pieces according to the preamble of claim 1.

PRIOR ART

The prior art has disclosed contact elements, which can also be called contact lamellae. For example, EP 0 716 474 describes a contact element that comprises a unipartite contact strip that extends along a longitudinal direction and by way of which two opposite contact faces can be electrically connected. The length of the contact strip can be slightly deformed, so that said contact strip can be installed in a simple manner.

Even though the deformation of the contact strip during installation is highly advantageous, the contact lamella according to EP 0 716 474 exhibits a few disadvantages.

Firstly, the scalability in respect of the electric currents to be transmitted is highly limited. An increase in the current is typically also accompanied by an increase in the cross section of the contact element. Scaling of this kind is not readily possible because otherwise advantageous properties are lost. For example, the contact element becomes stiffer in the event of an increase.

Secondly, the mechanical plugging force can be influenced only to a slight extent in the case of use of the lamella in a socket or plug connection.

Furthermore, also the insertion area resp. deflection area in respect of the geometric dimensions between the two contact areas is limited.

SUMMARY OF THE INVENTION

Proceeding from this prior art, the object of the invention is to specify a contact element that overcomes the disadvantages of the prior art. A particular aim is that the contact element can be configured more easily for various applications.

This object is achieved by a contact element as claimed in claim 1. According to said claim, a contact element for establishing electrical contact between two contact pieces comprises a carrier strip that extends in the longitudinal direction and a plurality of contact parts that are connected to the carrier strip. The carrier strip, which extends in the longitudinal direction, is designed in such a way that, when a force is applied to the carrier strip, the length of the carrier strip changes in the longitudinal direction. The contact parts each comprise at least a first contact section for making contact with one of the two contact pieces, at least one second contact section for making contact with the other of the two contact pieces, and also at least one fastening section for fastening the contact part to the carrier strip.

Owing to the arrangement of the contact parts, which are responsible for actually establishing electrical contact, a defined electrical contact can be achieved between the two contact pieces. Owing to the carrier strip, of which the length can be changed, in particular during installation of the contact element, an extension or compression of the contact element can be achieved, without the contact parts being affected by it. As a result, the contact parts can be dimensioned in respect of the electrical contact function and the longitudinal extensibility of the carrier strip can be independent of the dimensioning of the contact part. That is to say that the two functions "electrical contact" and "longitudinal extensibility" can be dimensioned independently of one another.

The expression "that the carrier strip is designed in such a way that, when a force is applied to the carrier strip, the length of the carrier strip changes in the longitudinal direction" is intended to be understood to mean that the carrier strip as such is designed in such a way that its length changes when the force is applied. The change preferably takes place in the elastic region of the material of the carrier strip.

The carrier strip is preferably designed in respect of its shape resp. its configuration in such a way that its elasticity in the longitudinal direction is increased resp. its elastic deformability as seen in the longitudinal direction is increased. As a result, the change in length can be aided by applying said force to the carrier strip.

The carrier strip particularly preferably comprises regions or means with which the elasticity resp. the elastic deformability of the carrier strip in the longitudinal direction is increased. Owing to said regions resp. means, the carrier strip is designed in such a way that the length of said carrier strip can change particularly effectively and especially to the desired extent. Therefore, the carrier strip is improved in respect of its longitudinal deformability.

A region of this kind resp. a means of this kind can be provided, for example, by incisions in the carrier strip and/or cutouts in the carrier strip and/or apertures through the carrier strip and/or by partial weakenings of the carrier strip. Said regions resp. means are particularly suitable for increasing the elasticity resp. the elastic deformability of the carrier strip in the longitudinal direction.

Particularly preferably, said regions resp. means each extend in a manner offset in the longitudinal direction and from both sides of the carrier strip alternating into the carrier strip. That is to say, a first region resp. a first means extends into the carrier strip from the right-hand side, while a second region resp. a second means extends into the carrier strip from the left-hand side, wherein the two regions resp. means are offset in relation to one another as seen in the longitudinal direction.

Furthermore, in the case of deformation of the carrier strip, the contact parts, which are provided for electrical contact, are not deformed and as a result negatively influenced, but rather the carrier strip is mechanically deformed.

A line preferably extends through the carrier strip in the longitudinal direction. The line is preferably a line that is situated centrally in the carrier strip. The contact parts are situated in relation to the carrier strip in such a way that the contact parts are pivoted resp. can be pivoted about a pivot line. The pivot line is situated in a manner angularly inclined at an angle of less than 30°, in particular substantially parallel, in relation to said line.

The angle therefore lies in the range of from 0° to 30°. A pivot line that is situated substantially parallel is intended to be understood to mean that the pivot line is situated precisely parallel or at a small angle of up to 3° or up to 5° in relation to the center line.

Owing to this design, the contact parts are deflected substantially parallel in relation to the insertion direction. Said pivot line is preferably situated orthogonally in relation to the insertion direction.

In other words, the substantial orientation of the contact part is preferably transverse in relation to the longitudinal direction in a particularly preferred variant. In the case of a contact process, this has the result that the contact part pivots about the pivot line, which is oriented at a right angle in relation to the insertion direction in the installation position, in the event of a contact movement.

In the case of a contact process, the orientation of the contact parts transverse in relation to the carrier strip has the result that the contact part pivots about the pivot line, which is oriented at a right angle in relation to the insertion direction in the installation position, in the event of a contact movement.

Owing to the arrangement of the contact parts so that the described manner of pivoting is made possible, the contact parts are pivoted substantially in the insertion direction during installation, as a result of which the stress for the carrier strip is lower. Furthermore, the contact element for the plug-in connector can be dimensioned in a simple manner. In particular, the contact parts can be dimensioned independently and freely of the carrier strip. Particularly preferably, the cross section of the contact parts can be changed in a very simple manner.

However, other orientations are also conceivable. As mentioned, the pivot line can also be situated in a manner inclined at an angle in relation to the center line. The angle can be up to 30°. In this case, the pivot lines of individual contact parts run parallel with respect to one another but not in a collinear manner.

Depending on the installation position, the carrier strip extends cylindrically around a center axis, wherein the line and the pivot line then likewise extend cylindrically around the center axis. In this context, the expression that the line and the pivot line are parallel is intended to be understood to mean that the cylindrically circulating line and the cylindrically circulating pivot line are situated in parallel planes that are transverse in relation to the center axis. This configuration of the installation position occurs, for example, in the case of a socket and plug connection.

Owing to the arrangement of the contact parts, which are responsible for actually establishing electrical contact, a defined electrical contact can be achieved between the two contact pieces. Furthermore, in the case of deformation of the carrier strip during the contact process, the contact parts, which are provided for electrical contact, are not deformed and as a result negatively influenced, but rather the carrier strip is mechanically deformed.

The contact part preferably moves relative to the contact face of the corresponding contact piece during pivoting about the pivot line, wherein the movement runs transverse in relation to the pivot line. Said movement is a combined movement of the contact part, which movement is made up of the pivot movement and of the movement on the contact face.

The second contact section is preferably situated in the region of the fastening section. Furthermore, the contact part is designed with a rounded portion in the second contact section, which rounded portion extends around a rounded portion axis that runs parallel to the longitudinal direction. The rounded portion axis and the pivot line run in a substantially collinear manner in relation to one another at least over the width of the contact part.

The second contact section preferably rolls, by way of its rounded portion, on the contact face and is optionally designed such that it can be displaced with respect to the contact face.

The second contact section preferably at least partially or completely surrounds the carrier strip in the region of its outer edge, wherein said fastening section is situated on the inner side of the contact part, which inner side faces the carrier strip.

In one embodiment, contact parts are arranged on either side in relation to the carrier strip. In another embodiment, contact parts are arranged on one side of the carrier strip.

In one development, the carrier strip that extends in the longitudinal direction comprises a plurality of fastening spots, in the form of fastening lugs, which are spaced at a distance in relation to one another in the longitudinal direction, wherein the carrier strip is designed in such a way that, when a force is applied to the carrier strip in the longitudinal direction, a relative displacement of the fastening lugs in relation to one another is possible. The contact parts each comprise a first contact section for making contact with one of the two contact pieces, a second contact section for making contact with the other of the two contact pieces, and also a fastening section for fastening the contact part to a fastening lug.

Preferably, precisely one single contact part is provided for each fastening lug. The number of fastening lugs corresponds to the number of contact parts.

A relative displacement is intended to be understood to mean that the length of the carrier strip is extended or compressed. The distance between the two contact parts as seen in the longitudinal direction becomes larger in the event of an extension and smaller in the event of a compression.

The degree of expansion or compression in the longitudinal direction preferably corresponds substantially to the initial length in the undeformed state plus or minus 10% to 40% of the initial length.

The relative displacement preferably runs transverse in relation to the orientation of the contact parts.

The contact parts are designed separately from the carrier strip and are fixedly connected to the carrier strip by means of the fastening section. The contact part is preferably connected to the carrier strip by means of a mechanical connection. The contact part can be connected to the carrier strip in an interlocking manner and/or cohesive manner and/or force-fitting manner. The fastening section of the contact part and the carrier strip resp. the fastening lugs of the carrier strip have corresponding elements, which enable the fastening.

The material of the carrier strip is preferably different from the material of the contact part. The material of the carrier strip preferably has good elastic deformation properties and the material of the contact part preferably exhibits a good electrical conductivity.

The material of the carrier strip is preferably composed of metal, in particular steel, particularly preferably spring steel or stainless spring steel. The material of the contact part is preferably composed of copper or alloys thereof. The contact part is preferably provided with a coating that improves electrical contact. For example by a silver coating.

The carrier strip is preferably produced by a sheet-metal strip, in particular a sheet-metal strip that is shaped by means of a punching process or laser cutting. However, the sheet-metal strip can also be produced in some other way.

Preferably, each two fastening lugs that follow one another in the longitudinal direction are connected to one another by means of a web. The web is preferably designed in such a way that said extension or compression is provided at least partially or completely by the web. For this, the web is preferably deformed relative to the fastening lug. However, the fastening lugs can also be connected to one another in some other way such that, when a force is applied to the carrier strip, the length of the carrier strip changes in the longitudinal direction.

Particularly preferably, the web is angularly inclined at an angle in relation to the longitudinal direction. The web therefore extends in a manner inclined at an angle in relation to the longitudinal direction.

Said angle preferably lies in the range of from 45° to 90°. The angle is determined substantially by the distances between two opposite fastening lugs and the width of the carrier strip.

The web preferably connects to one another two fastening lugs that are situated immediately one after the other with respect to the longitudinal direction. Particularly preferably, there is precisely one single web between two fastening lugs. However, it would also be conceivable to arrange a plurality of webs between two fastening lugs.

The web can be designed as a continuous web. As an alternative, it is also conceivable to arrange a slot in the web, which slot runs in the direction of the web and which aids the deformability of the web when said force is applied.

In other words: The fastening lugs are preferably connected to one another by means of a web, which web is arranged in such a way that, when a force is applied to the carrier strip in the longitudinal direction, a relative displacement of the fastening lugs in relation to one another is possible.

Particularly preferably, a line in the form of a center line extends centrally through the carrier strip in the longitudinal direction, wherein in each case a first fastening lug is arranged on a first side laterally in relation to the center line and in each case a second fastening lug is arranged on a second side laterally in relation to the center line. The web in each case connects a first fastening lug and a second fastening lug. A further web connects said second fastening lug to a further first fastening lug.

Therefore, the arrangement of the web is repeated, wherein the web preferably alternately connects a first fastening element to a second fastening element and then connects the second fastening element to a further first fastening element.

In other words: The webs therefore alternately connect a first fastening lug to a second fastening lug and the second fastening lug to a following first fastening lug.

The webs preferably in each case connect a first fastening lug and a second fastening lug in such a way that a meandering or zigzag-like design of the carrier strip is created.

Preferably, the first contact part that is connected to the first fastening lug is oriented by way of its first contact section toward the second contact part that is connected to the second fastening lug and/or the second contact part that is connected to the second fastening lug is oriented by way of its first contact section toward the first contact part that is connected to the first fastening lug.

The first contact part, as seen from its fastening lug, preferably extends in such a way that the first contact section, as seen transverse in relation to the longitudinal direction, extends beyond a second contact part in such a way that, in the event of a contact movement from the side of the second contact part, the first contact part is first contacted by the contact piece.

Particularly good contacting of the contact parts can be achieved in this way. Furthermore, the degree of compactness of the contact element can be increased.

Preferably, the second contact parts are arranged in a similar way, whose second contact section, as seen transverse in relation to the longitudinal direction, extends beyond a first contact part, in such a way that, in the event of a contact movement from the side of the first contact element, the second contact element is first contacted by the contact piece.

Preferably, a second contact part extends into the intermediate space that is situated between two adjacent first contact parts, and a first contact part extends into the intermediate space that is situated between two adjacent second contact parts.

In other words, the contact parts are arranged in an interleaved manner in relation to one another.

The contact parts preferably extend from the respective fastening lug, by way of which the corresponding contact part is connected to the carrier strip, beyond the line, which extends in the direction of the longitudinal direction and is preferably situated centrally between the two fastening lugs. That is to say that the contact parts protrude beyond the line transverse in relation to the line. In this context, the line is preferably a center line.

Preferably, contact parts are arranged on either side in relation to the carrier strip, wherein there is an intermediate space between two contact parts that are arranged adjacent to one another on the same side, it being possible for a contact part that is arranged on the other side to protrude into said intermediate space.

Contact parts are preferably arranged to the left and to the right with respect to the line, in particular the center line. In this context, it is possible to refer to a left-hand side and a right-hand side with respect to the carrier strip, wherein one contact part is connected to the right-hand side and another contact part is connected to the left-hand side. The contact parts are arranged in a manner offset in relation to one another as seen along the line, in particular the center line.

Preferably, the first contact part that is connected to the right-hand side of the carrier strip is oriented, by way of its first contact section, toward the second contact part that is connected to the left-hand side of the carrier strip and/or the second contact part that is connected the left-hand side of the carrier strip is oriented, by way of its first contact section, toward the first contact part that is connected to the right-hand side of the carrier strip.

Preferably, the webs are designed in a manner bent about a line that is situated between the fastening spots resp. fastening lugs, in particular bent in a curved manner and/or bent once and/or bent several times, so that the surface of the fastening spots resp. fastening lugs, which are arranged on one side of the line, is situated in a manner inclined at an angle in relation to the surface of the fastening spots resp. fastening lugs, which are arranged on the other side of the line.

In other words: Seen in a cross section at a right angle in relation to the line, the fastening spots extend in a manner inclined at an angle in relation to a center region of the carrier strip.

Owing to the bent design, the webs act as spring elements in such a way that, as seen in the longitudinal direction, the respective contact parts can be pivoted from an initial position to a contact position about its second contact section.

In other words: The webs preferably have at least one bending line that extends parallel in relation to the longitudinal direction. Regions of the web and the fastening lugs run starting from the bending line in a manner angularly inclined at an angle with respect to a plane, which is spanned by the longitudinal direction and a transverse axis that is situated transverse in relation thereto. The inclination at an angle is such that the contact parts are situated in a manner inclined at an angle in relation to said contact faces of the contact pieces or in relation to said plane.

In one variant, two bending lines are provided for each web. The two bending lines are situated at a distance in relation to one another and are preferably symmetrical, that is to say positioned at the same distance from a center line that is situated centrally between the two fastening lugs.

The bending lines can be of rounded design or can be designed as sharp corners.

Owing to the bent or multiply bent design of the web, it can also be stated that the carrier strip is of V-shaped or U-shaped or trapezoidal or semicircular design in cross section transverse in relation to the longitudinal direction.

In another variant, the web is designed as a curved portion that connects the lugs. Consequently, the web extends in the form of a curved portion from lug to lug. The web is preferably designed in a manner curved about a center line that runs in the direction of the longitudinal axis. The radius of the curved portion is advantageously selected to be as large as possible depending on the installation situation.

The first contact section preferably forms a free end with respect to the carrier strip and protrudes away from or sticks out of the carrier strip. The first contact section therefore does not lie on top of the carrier strip at least in the initial position, i.e. in the non-deflected state. However, the first contact section, depending on the design, can come into contact with the carrier strip in the contact position. The free end can protrude through the carrier strip through a recess in the carrier strip in the deflected state, i.e. in the contact position. The recess is provided by the intermediate region between two webs.

The second contact section is preferably situated in the region of the fastening section, which fastening section is fixedly connected to the fastening lug. As an alternative, the fastening section is arranged between the first contact section and the second contact section, wherein the two contact sections, as free ends, protrude away from the carrier strip at least in the non-deflected state or sticks out of said carrier strip.

The contact part is preferably designed with a rounded portion in the first contact section, which rounded portion extends around a rounded portion axis, which runs parallel in relation to the longitudinal direction, and/or the contact part is designed with a rounded portion in the second contact section, which rounded portion extends around a rounded portion axis, which runs parallel in relation to the longitudinal direction. The required insertion force can be optimized due to the rounded portions.

The rounded portion radii can be matched to the contact situation.

A rounded portion can be understood to mean a rounded portion with a constant radius or a non-constant radius or an n-gonal or a polygonal chain.

The second contact section of the contact part is preferably situated in relation to the carrier strip in such a way that the carrier strip and possibly the rivet do not come into connection with the contact piece in the contact position. For example, the second contact section can be offset or bent away from the bottom side of the connecting section that is situated on the carrier strip. The second contact section can therefore be part of a raised portion with respect to the fastening section.

The cross section of the contact part in the region of the fastening section is preferably larger than the cross section of the contact part in the region of the first contact section. The cross section of the first contact section is therefore designed in a tapered manner with respect to the fastening section. As an alternative or in addition, the cross section of the contact part in the region of the fastening section is larger than the cross section of the contact part in the region of the second contact section. As an alternative, the cross section of the contact part in the region of the fastening section can be substantially equal to the cross section in the region of the second contact section.

The contact part can therefore be formed in a manner reduced in size in sections.

As a result, effective mounting of the fastening section on the fastening lugs can be achieved with optimum utilization of material.

The contact part particularly preferably tapers from the fastening section toward the first contact section.

As explained above, the contact part is fastened to the fastening spot or to the fastening lug of the carrier strip by means of the fastening section. In this case, the fastening section can be formed in various ways.

In a first embodiment, the contact part, by way of the fastening section, is connected to the fastening spot by at least one plastically deformable connecting element, in particular a rivet, wherein the at least one connecting element is formed in one piece with the contact part. The connecting element, in particular the rivet, is therefore an integral constituent part of the contact part.

Preferably, multiple connecting elements or rivets, in particular at least two thereof, are provided.

In this case, the connecting elements or rivets extend away from a bottom side of the contact part, which faces the carrier strip, protrude through apertures in the fastening spot and are plastically deformed on that side of the carrier strip that is opposite the support of the contact part.

To assist plastic deformation, the connecting element or the rivet can also further be welded or soldered.

The at least one connecting element or the rivet preferably has a round or an oval or a polygonal or an n-gonal cross section. The at least one connecting element particularly preferably has a cross section that complements an elongate hole. That is to say, the cross section is substantially in the shape of a rectangle, wherein two opposite side edges are formed in a rounded manner.

The arrangement of the plastically deformable connecting element provides the advantage that the contact part can be connected to the carrier strip in a simple manner. As a result, the contact element can be produced in a simple manner. Furthermore, the separate configuration between the carrier strip and the contact part provides the advantage that the contact parts can be dimensioned independently of the carrier strip. In particular, the contact part can be formed with a high material content, which has the advantage that higher currents can be transmitted.

In a first embodiment, the at least one connecting element is an integral constituent part of the contact part or of the fastening section. Furthermore, the at least one connecting element has a shaft that protrudes away from the fastening section, which shaft is plastically deformed in a shaping process in such a way that the shaft forms a mechanically fixed connection with the carrier strip.

The expression "integral constituent part" is intended to be understood to mean that the contact part and the connecting element resp. the shaft are formed in one piece. That is to say, the connecting element and the contact part form a one-piece structure. In other words, the connecting element is integrally formed with the contact part.

The one-piece design of the contact part provides the advantage that a single element, namely the contact part, has to be connected to the carrier strip during assembly. That is to say, the provision and handling of additional fastening elements is omitted.

In addition, the contact part itself can be efficiently produced in a simple manner and in large numbers by a shaping method.

The at least one connecting element is preferably formed in one piece with the contact part in one piece by means of the fastening section.

In particular, the at least one connecting element is formed from the fastening section.

The at least one connecting element is particularly preferably pressed out of the fastening section by means of a stamping process or a press joining process. That is to say, the connecting element can be formed by material that already is present at the fastening section.

After the connecting element has been pressed out, the fastening section preferably has an indentation opposite the connecting element, wherein the volume of the indentation corresponds substantially to the volume of the connecting element that has been pressed out. The fastening section is therefore plastically deformed in the region of the connecting element in order to form the connecting element. The fastening section is preferably not formed with an increased material content in the region of the connecting element, as a result of which said indentation is produced by the plastic deformation.

In a second embodiment, the at least one plastically deformable connecting element is arranged fixedly on the contact part before the plastic deformation and before the connection to the carrier strip. Furthermore, the at least one connecting element has a shaft that protrudes away from the fastening section, which shaft is plastically deformed in a shaping process in such a way that the shaft forms a mechanically fixed connection with the carrier strip.

According to the second embodiment, the at least one plastic connecting element is fixedly arranged on the fastening section before the shaping process, that is to say before the plastic deformation of the shaft. That is to say, the connecting element can be a separate element, which is fixedly connected to the contact part by means of the fastening section before the connection to the carrier strip and before the riveting. That is to say, the connecting element and the contact part form a one-piece structure for assembly on the carrier strip, which has the advantages cited above in connection with the first embodiment.

According to the second embodiment, the at least one connecting element preferably protrudes by way of the shaft through an opening in the fastening section and is fixedly fastened to the fastening section, wherein the fastening is established in an interlocking manner and/or a force-fitting manner and/or a cohesive manner.

The expression "mechanically fixed" is intended to be understood in respect of all embodiments to mean that the contact part is fixedly connected, that is to say connected in a substantially non-detachable manner, to the carrier strip by means of the plastically deformed shaft. The mechanically fixed connection is preferably a force-fitting connection and/or an interlocking connection and/or a cohesive connection.

Preferably, the shaft is pressed against the wall of the fastening opening by the shaping process for the purpose of mechanical connection in all of the embodiments. The shaft is therefore plastically deformed during the shaping process, as a result of which its diameter becomes larger. That is to say, the shaft is pressed against the wall of the fastening opening by way of its casing surface transverse in relation to the shaft axis. Said force-fitting connection can be provided in this way.

As an alternative to this, for the purpose of mechanical connection, the connecting element, by way of its shaft, protrudes beyond the carrier strip before the plastic deformation and a head section is formed at the protruding end of the shaft by the shaping process, the dimension of said head section transverse in relation to the shaft axis being larger than the cross section of the fastening opening. Said interlocking connection can be provided in this way.

In a further alternative, for the purpose of mechanical connection, the shaft is pressed against the wall of the fastening opening by the shaping process and a head section is formed at the protruding end of the shaft by the shaping process, the dimension of said head section transverse in relation to the shaft axis being larger than the cross section of the fastening opening. Said force-fitting connection and interlocking connection can be provided in this way.

In all of the embodiments described herein, the shaft is preferably deformed over its entire cross section with respect to the protruding part. That is to say, the shaft is completely plastically compressed over its cross section by a tool. As an alternative to this, the shaft can also be selectively deformed at different subregions of its cross section. That is to say that, specifically in the case of relatively large cross sections, only subregions of the shaft can also be plastically deformed. For example, a tool can engage at different spots on the shaft end, so that not the entire shaft cross section is reshaped.

To assist plastic deformation, the connecting element can also further be welded.

Preferably, in all of the embodiments described herein, the shaft that protrudes away from the fastening section has, in the undeformed state, a length that corresponds at least to the thickness of the carrier strip and/or that corresponds at most to the thickness, in particular to half the thickness, of the fastening section.

The thickness of the carrier strip is the dimension of the carrier strip in the direction of the extension of the shaft.

Preferably, in all of the embodiments described herein, there are precisely two connecting elements or more than two connecting elements for each contact part. As an alternative, there can also be a single connecting element.

The precisely two connecting elements or the more than two connecting elements are preferably spaced at a distance in relation to one another, wherein the distance is, in particular, formed in such a way that the connecting elements do not touch in the deformed state. That is to say that the connecting elements can be deformed independently of one another and primarily without negatively influencing one another.

Preferably, the connecting element, as seen from the fastening section, extends along a shaft axis in all of the embodiments described herein, wherein the dimension in a first transverse axis that is transverse in relation to the shaft axis is larger than the extent in a second transverse axis that is transverse in relation to the shaft axis and in relation to the first transverse axis. As an alternative, the dimension can also be the same. The connecting element is shaped in a non-round resp. not round manner. The advantage of this design is that the cross section of the connecting element can be optimized, in particular can be selected to be as large as possible.

The first transverse axis preferably runs in a manner inclined at an angle in relation to the longitudinal direction of the carrier strip. However, the first transverse axis can also be at a right angle in relation to the longitudinal axis.

Preferably, the at least one connecting element in all of the embodiments described herein has a round or an oval or a polygonal or an n-gonal cross section. The at least one connecting element particularly preferably has a cross section that complements an elongate hole. That is to say, the cross section is substantially in the shape of a rectangle, wherein two opposite side edges are formed in a rounded manner.

The shape of the fastening opening preferably corresponds to the shape of the connecting element. There can be a small degree of backlash with a range of at most 0.1 millimeters between the connecting element and the fastening opening.

Preferably, the connecting element has a full cross section in all of the embodiments described herein. That is to say, the shaft has a full cross section. However, the shaft may also be of hollow design.

The connecting element can also be called a rivet.

In a second and a third embodiment, the contact part is connected to the fastening lug by way of at least one rivet in the fastening section. The rivet protrudes through the fastening section and the fastening lug of the carrier strip.

In the second and the third embodiment, it is advantageous, for the purpose of receiving the rivet, if during production of the contact parts and of the carrier strip apertures are already prefabricated at the corresponding spots, that is to say in the fastening section and in the fastening lug. The rivet therefore extends through an aperture in the fastening lug and an aperture in the fastening section. The number of apertures corresponds to the number of rivets.

The rivet according to the second embodiment is preferably arranged between the first contact section and the second contact section.

According to the third embodiment, the rivets are preferably designed from an electrically conductive material and are electrically conductively connected to the contact part. Furthermore, said second contact section of the contact part can be provided by the rivet.

The rivet of the first embodiment could also be designed in such a way that it provides said second contact section.

In addition, the connection according to the first, the second and the third embodiment between the rivet and fastening section and fastening lug could further be assisted by a welded connection or by a soldered connection.

According to a fourth embodiment, the contact part with the fastening section for fastening to the fastening lug at least partially or completely surrounds the fastening lug. The fastening lug is therefore at least partially surrounded by the fastening section, which is to say that the fastening section extends at least partially around the fastening lug.

In this fourth embodiment, it is preferred that an outer edge of the fastening lug, which outer edge runs parallel in relation to the longitudinal direction, and surfaces of the fastening lug that adjoin said outer edge are at least partially surrounded or completely surrounded by the contact part.

In the present case, the second contact section extends substantially around said edge.

In other words, the contact part is connected to the fastening lug by means of a kind of crimped connection. Said connection is a force-fitting and/or interlocking connection in this case. The crimped connection can additionally be further reinforced by means of a soldered or welded connection.

In a fifth variant, the contact part is fastened to the fastening lug by way of at least one clip element.

The clip element is preferably positioned in the region of a slot, which extends into the second contact section.

The clip element can further have barbs that get caught up with the contact part and with the fastening lug.

In one development of the contact element according to the above description, the ends of the carrier strip are connected to one another, so that a contact element that extends around a center axis results, wherein the two ends are preferably connected to one of said contact parts or wherein the ends are connected to one another by way of a separate element. Therefore, a ring is produced.

Depending on the orientation, the contact parts are situated within the carrier strip or outside the carrier strip.

An arrangement of an above-described contact element and also a first contact piece and a second contact piece is distinguished in that the contact element abuts, by way of its first contact section, against the first contact piece and, by way of the second contact section, against the second contact piece.

According to one development of the arrangement, the first contact piece is a socket part that extends around a center axis and the second contact piece is a pin part that extends around the center axis, wherein the carrier strip extends around the center axis, and wherein the longitudinal direction is situated transverse in relation to the center axis and extends around said center axis, The contact parts can preferably be brought into contact with the first contact piece by way of the respective first contact sections, and the contact parts are in contact with the second contact piece by way of the respective second contact sections, wherein the distance between the opposite second contact sections of the contact part is increased in the event of a contact movement.

Further embodiments are set forth in the dependent claims.

BRIEF DESCRIPTION OF THE DRAWINGS

Preferred embodiments of the invention will be described below on the basis of the drawings, which serve merely for explanation and are not to be interpreted as being restrictive. In the drawings:

FIG. 8*b* shows a view of the contact part according to FIG. 8*a* from below;

FIG. 8*c* shows a view of the contact part according to FIG. 8*a* from the side;

FIG. 8*d* shows a view of the contact part according to FIG. 8*a* from above;

DESCRIPTION OF PREFERRED EMBODIMENTS

Figure 1:
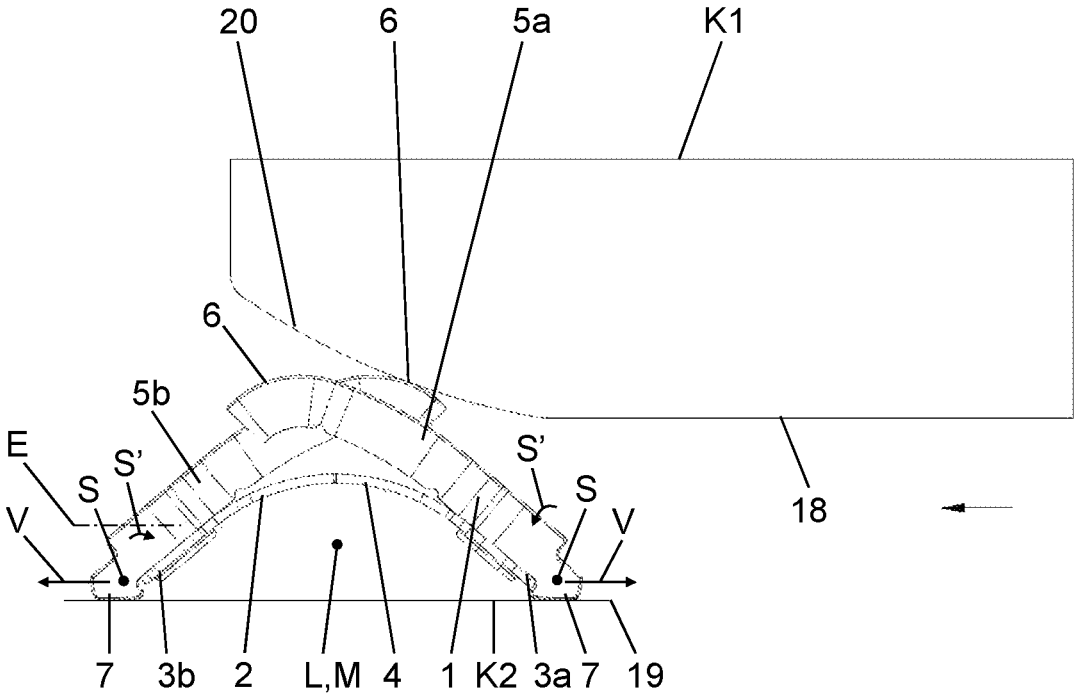
FIG. 1 shows a schematic view of a contact element and two contact pieces before the contact-making operation.
Figure 2:
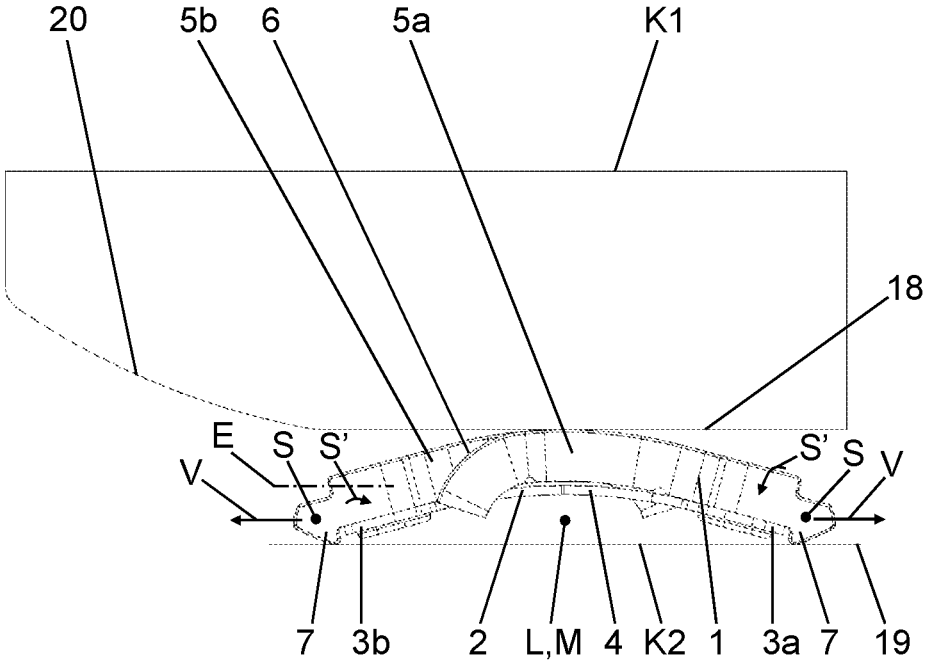
FIG. 2 shows the view according to FIG. 1 during the contact-making operation.

FIGS. 1 and 2 show a schematic illustration of two contact pieces K1, K2 and a contact element 1. In this case, the contact element 1 establishes electrical contact between the first contact piece K1 and the second contact piece K2. To this end, the contact element 1 makes contact with the contact face 18 of the contact piece K1 and with the contact face 19 of the contact piece K2. Due to its resilient properties, which will be described in greater detail in the text that follows, the contact element is always pressed against the two contact faces 18, 19 of the contact pieces K1, K2 in the contact position, as it is shown in FIG. 2.

During the contact-making operation, the first contact piece K1 is displaced relative to the second contact piece K2. The first contact piece K1, by way of the contact face 18, which here is designed with a rounded portion 20 in the front region, then makes contact with the contact element 1. The first contact piece K1 is then further displaced relative to the second contact piece K2, until the contact face 18 is completely connected to the contact element 1. On doing so, the contact position that is shown in FIG. 2 is achieved.

The contact element 1 for establishing electrical contact between the two contact pieces K1, K2 comprises a carrier strip 2 that extends in the longitudinal direction L and a plurality of contact parts 5 that are connected to the carrier strip 2. The carrier strip 2 serves to support the contact parts 5 and not to establish electrical contact, whereas the contact parts 5 are provided for establishing electrical contact. In FIGS. 1 and 2, the longitudinal direction L runs at a right angle in relation to the surface of the drawing sheet. Depending on the installation position of the contact element, the longitudinal direction L can be curved or extend along a straight line. For example, when the contact element 1 is installed into a socket/plug combination, the longitudinal direction L is formed in a circumferential manner about a center axis. During contacting of two contact pieces K1, K2 that are substantially flat, the longitudinal direction L can extend along a straight line.

Figure 3:
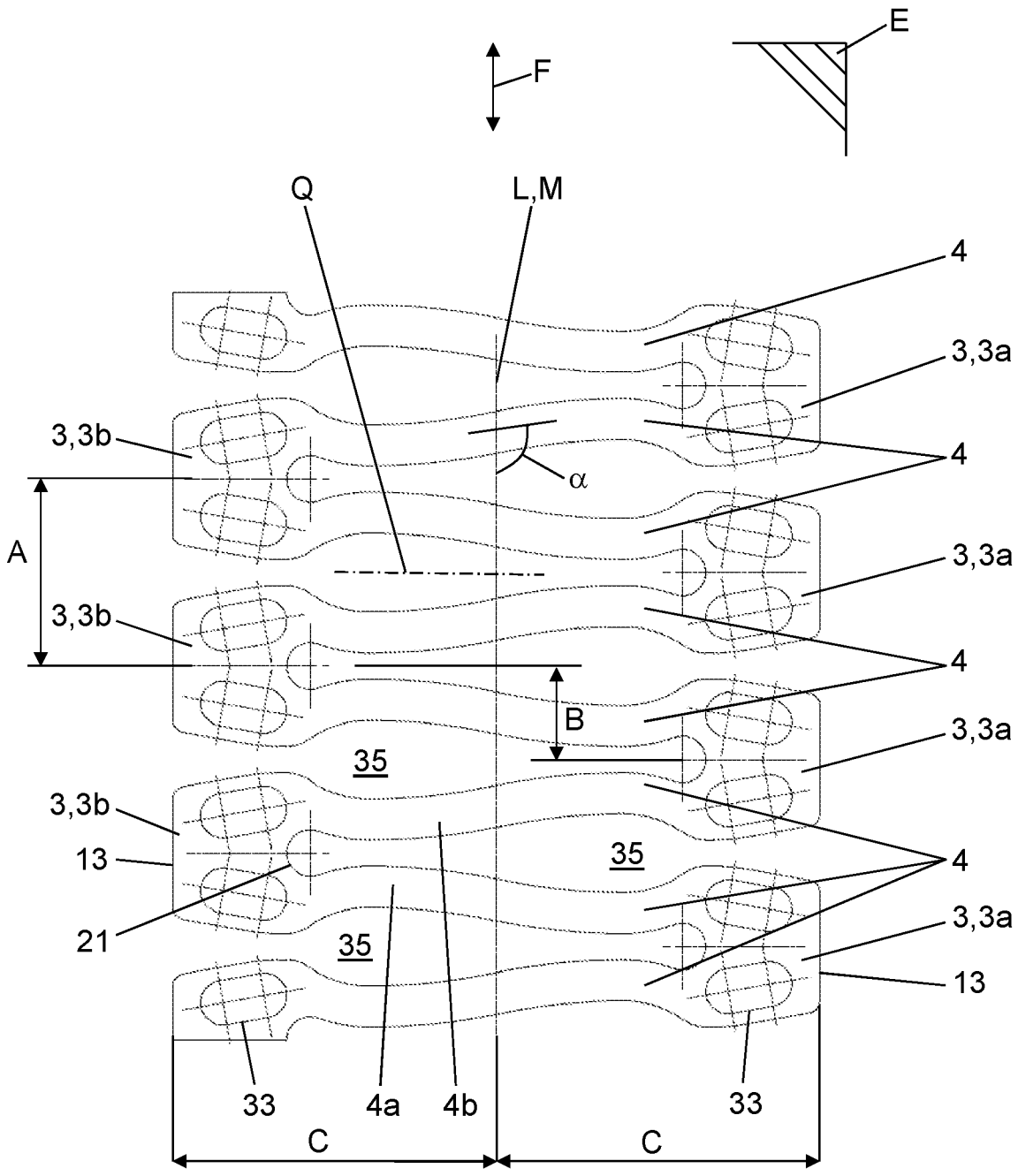
FIG. 3 shows a schematic view of a carrier strip of the contact element according to FIGS. 1 and 2.
Figure 4A:
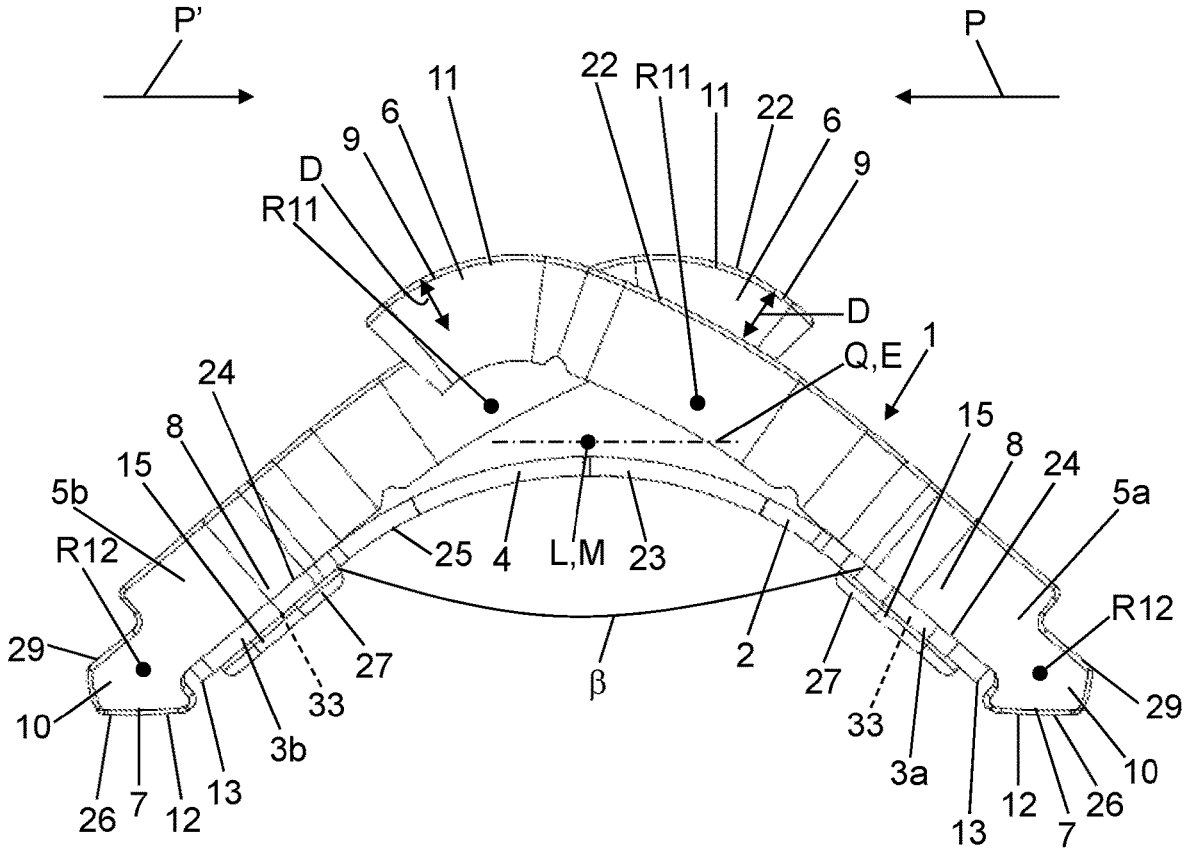
FIG. 4*a* shows a front view of a contact part according to a first embodiment of the present invention.
Figure 4B:
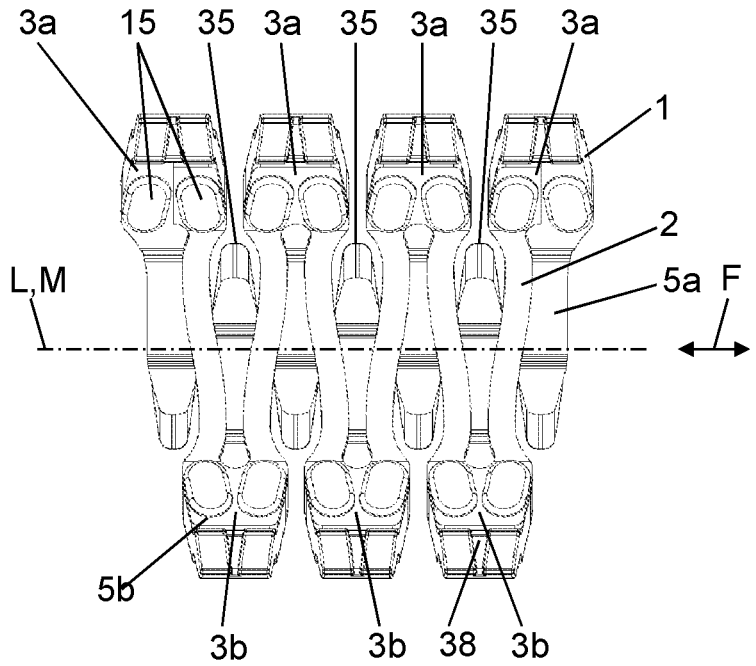
FIG. 4*b* shows a view of the contact part according to FIG. 4*a* from below.
Figure 4C:
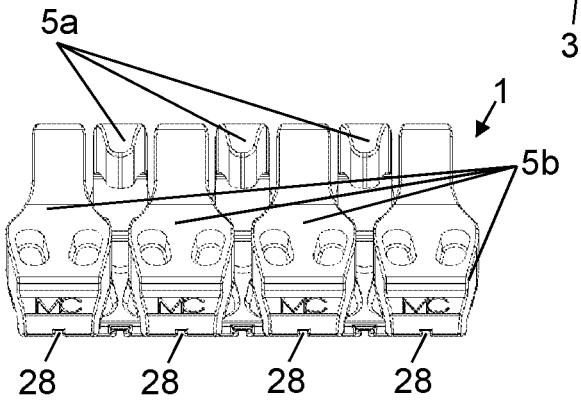
FIG. 4*c* shows a view of the contact part according to FIG. 4*a* from the side.
Figure 4D:
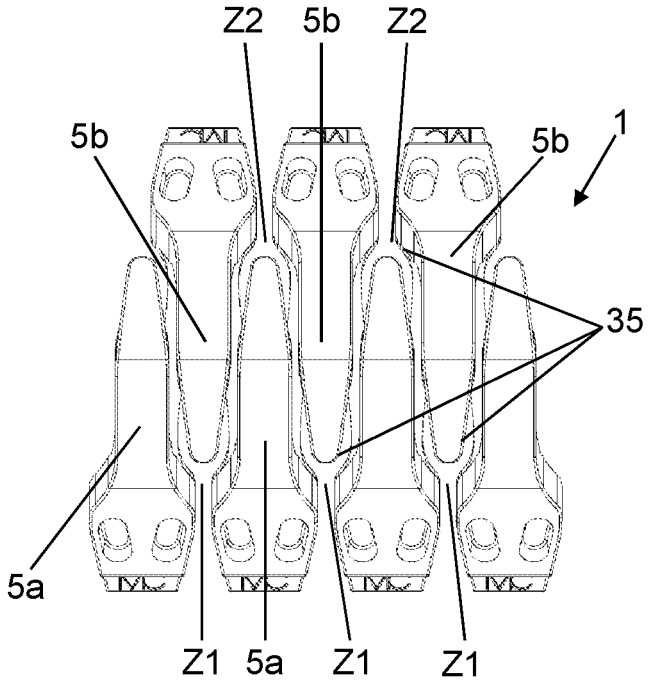
FIG. 4*d* shows a view of the contact part according to FIG. 4*a* from above.
Figure 4E:
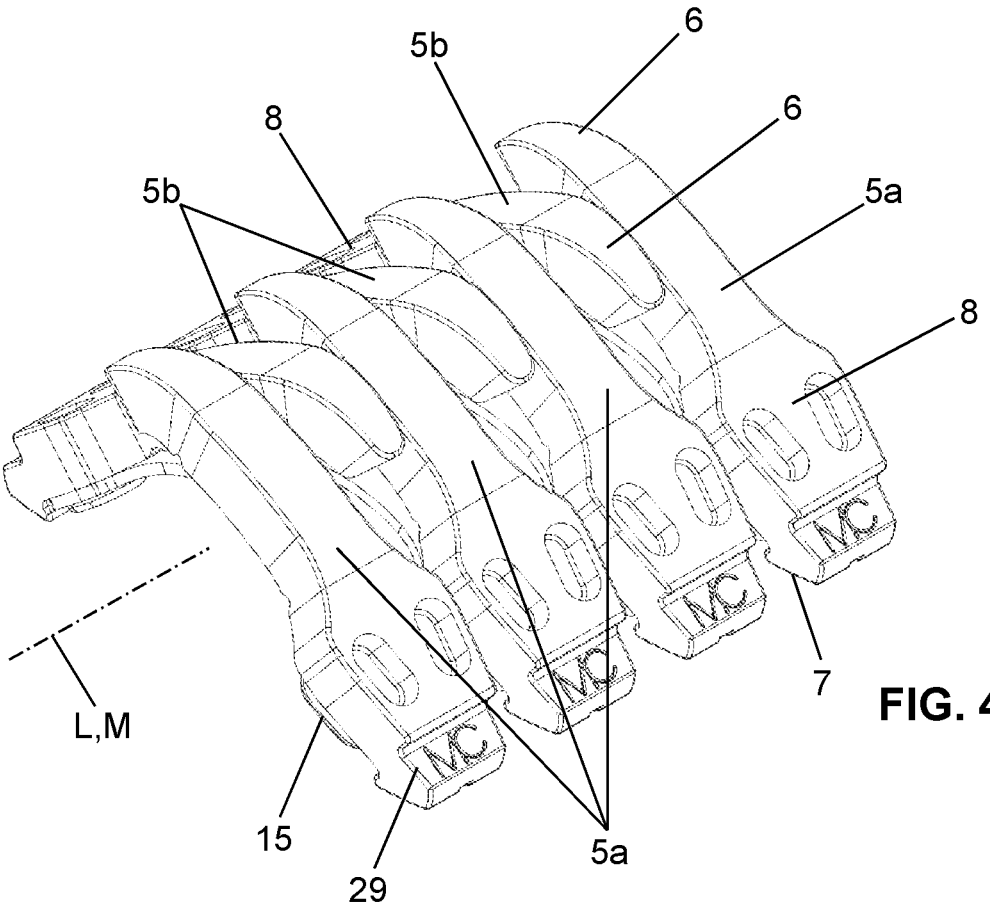
FIG. 4*e* shows a perspective view of the contact part according to FIG. 4*a* from above.
Figure 4F:
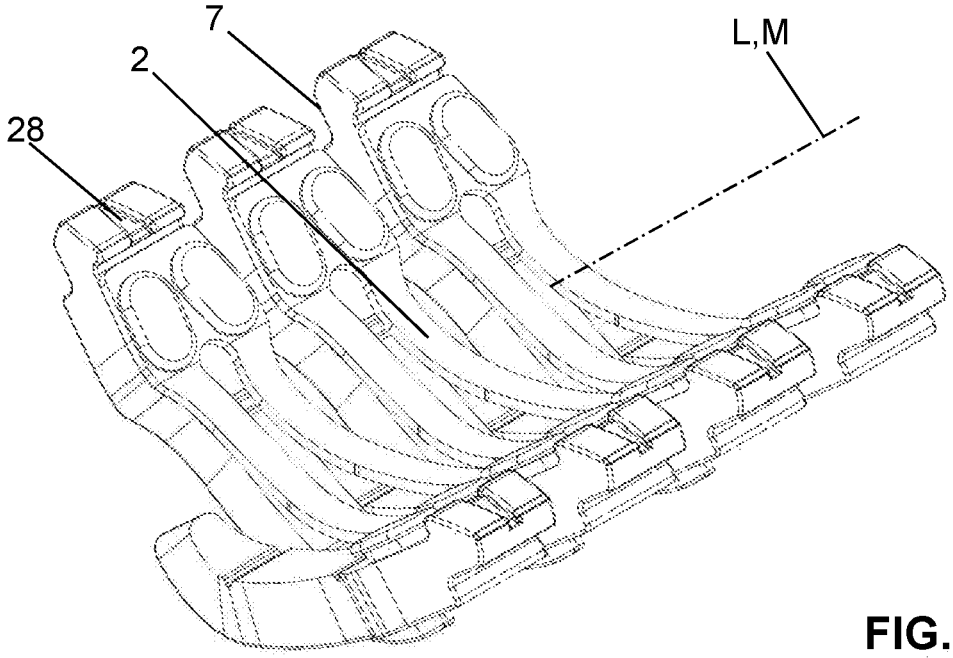
FIG. 4*f* shows a perspective view of the contact part according to FIG. 4*a* from below.
Figure 5A:
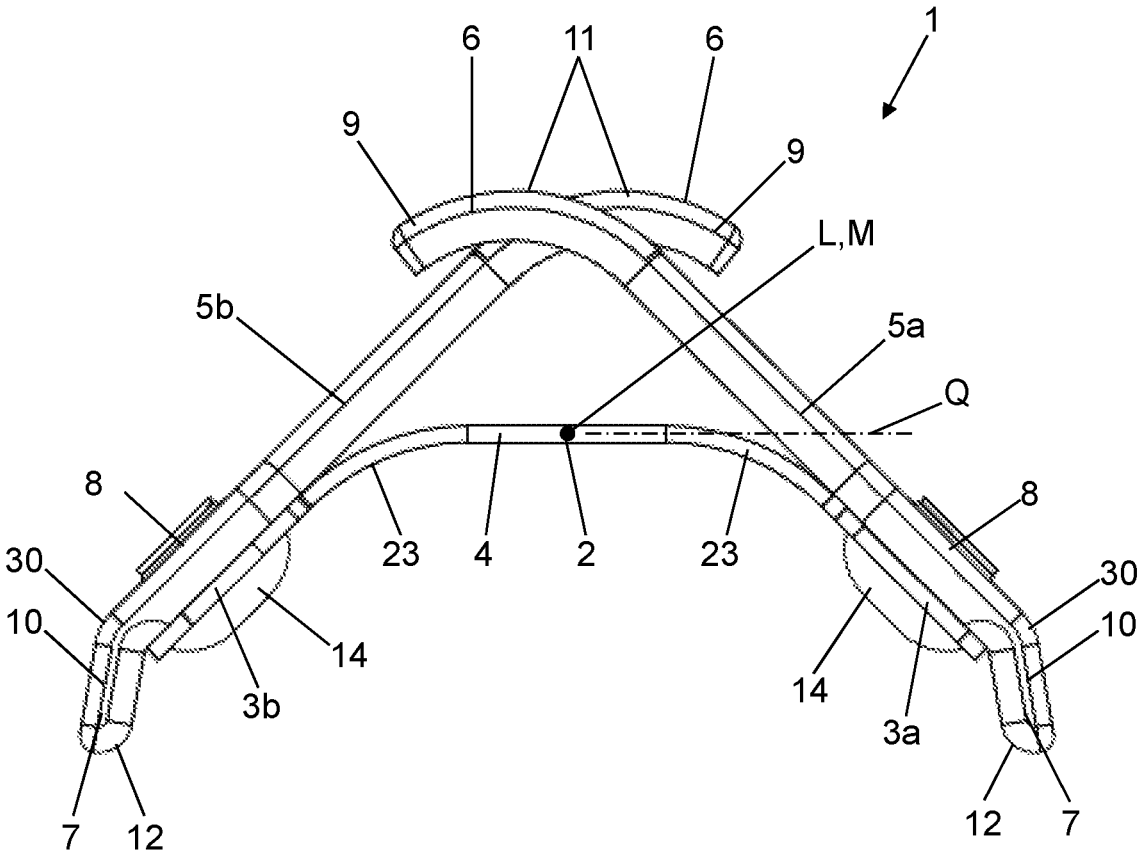
FIG. 5*a* shows a front view of a contact part according to a second embodiment of the present invention.
Figure 5B:
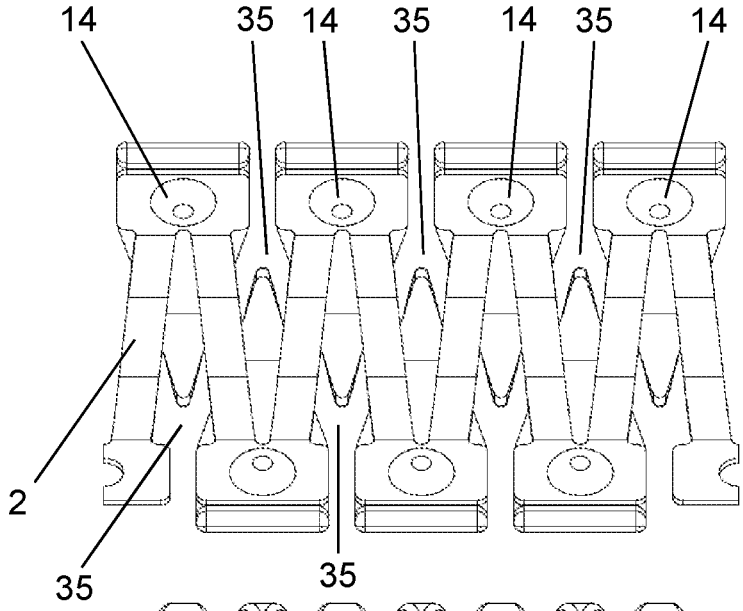
FIG. 5*b* shows a view of the contact part according to FIG. 5*a* from below.
Figure 5C:
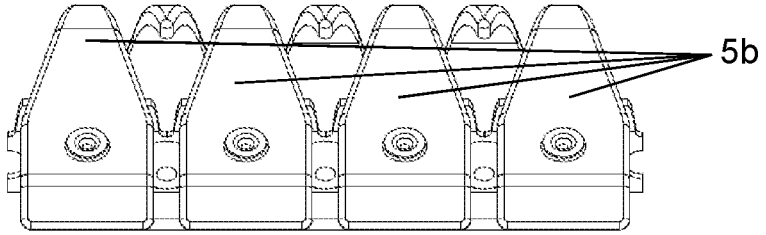
FIG. 5*c* shows a view of the contact part according to FIG. 5*a* from the side.
Figure 5D:
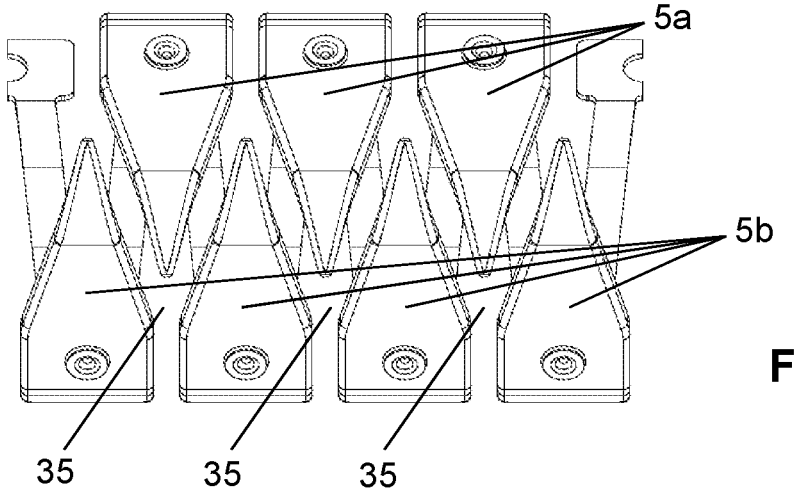
FIG. 5*d* shows a view of the contact part according to FIG. 5*a* from above.
Figure 5E:
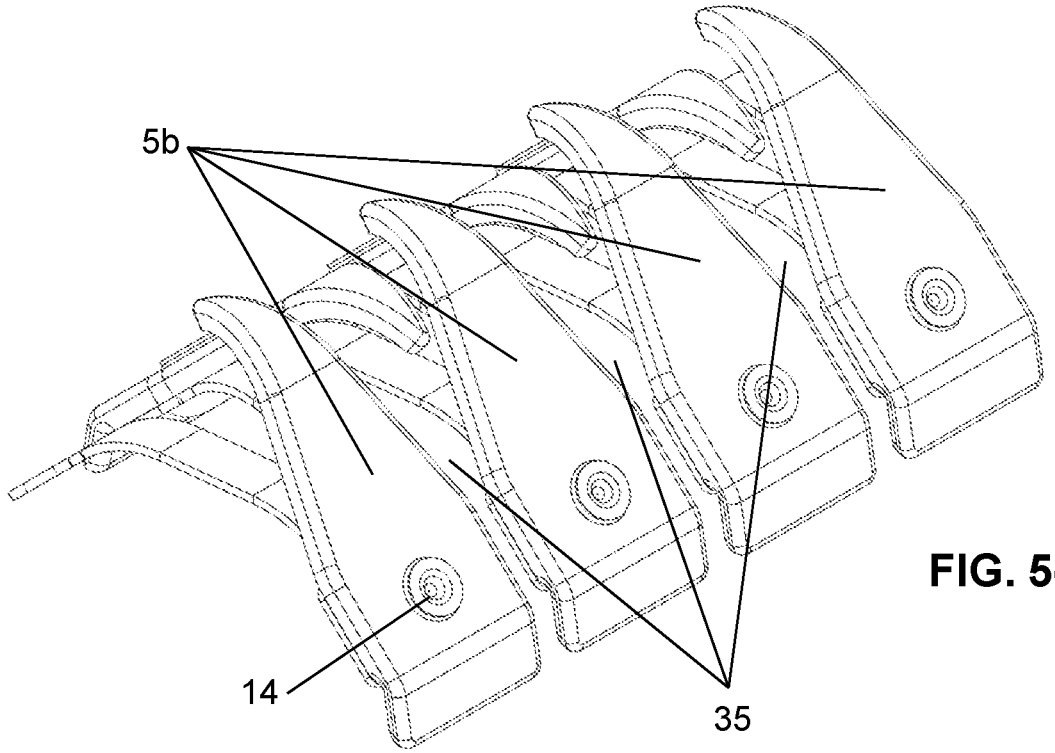
FIG. 5*e* shows a perspective view of the contact part according to FIG. 5*a* from above.
Figure 5F:
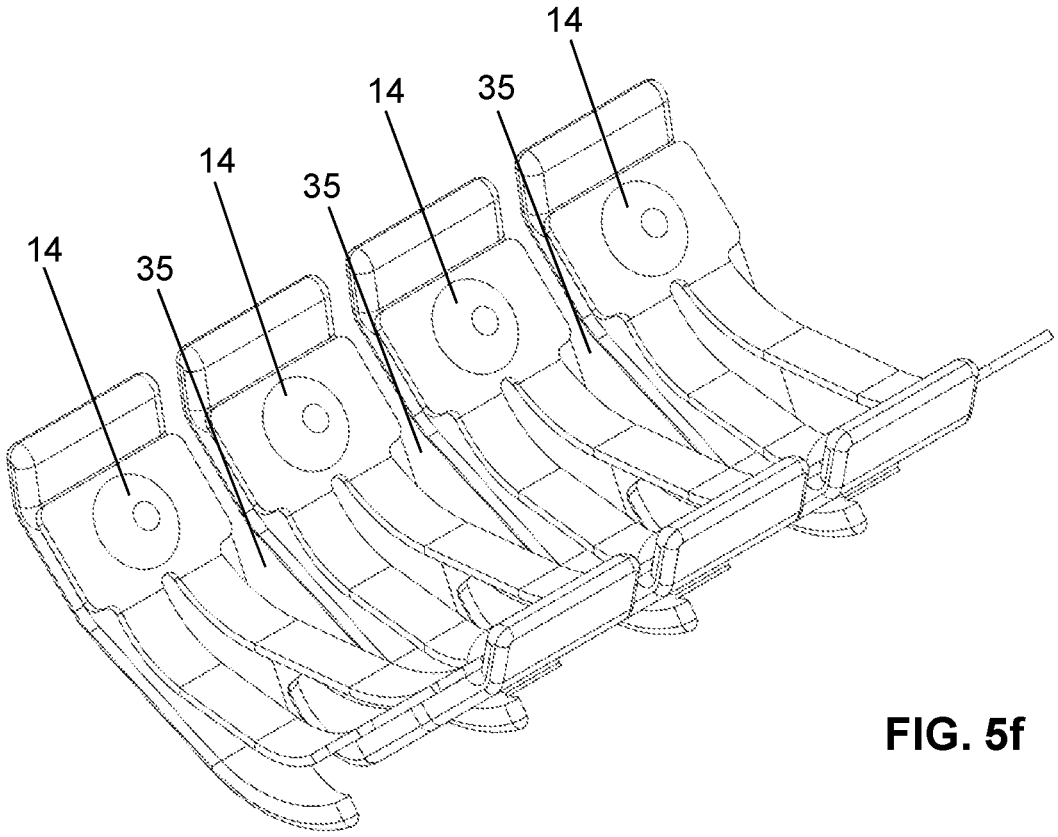
FIG. 5*f* shows a perspective view of the contact part according to FIG. 5*a* from below.
Figure 6A:
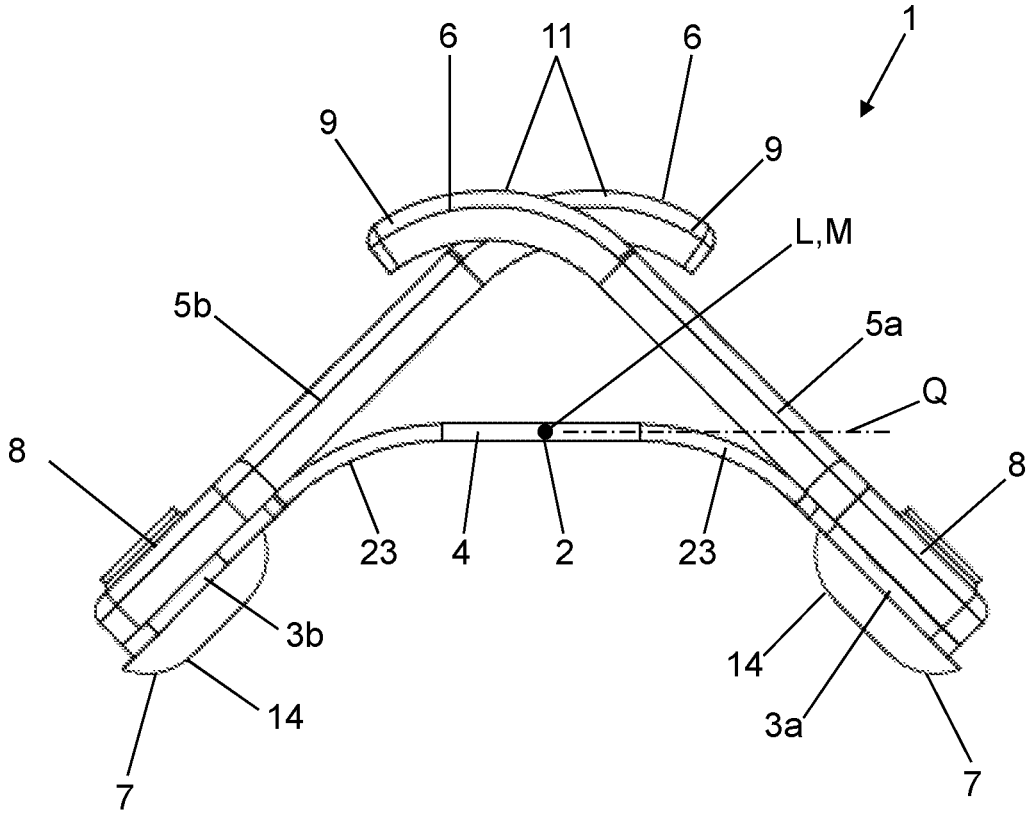
FIG. 6*a* shows a front view of a contact part according to a third embodiment of the present invention.
Figure 6B:
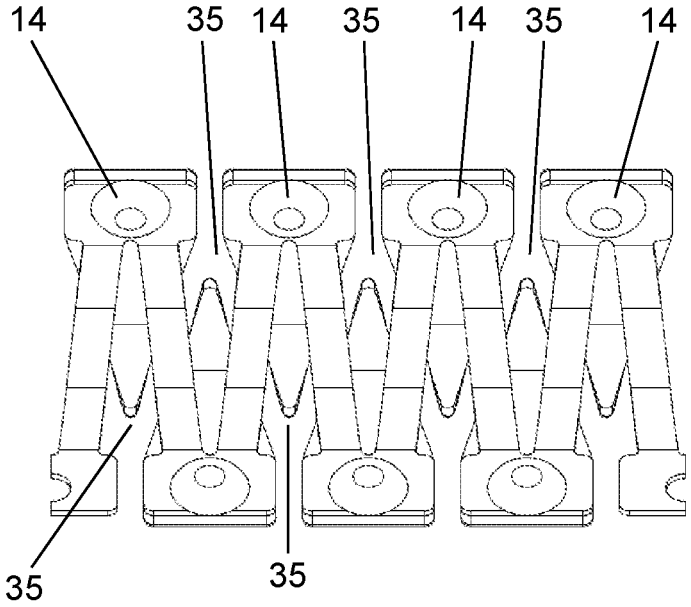
FIG. 6*b* shows a view of the contact part according to FIG. 6*a* from below.
Figure 6C:
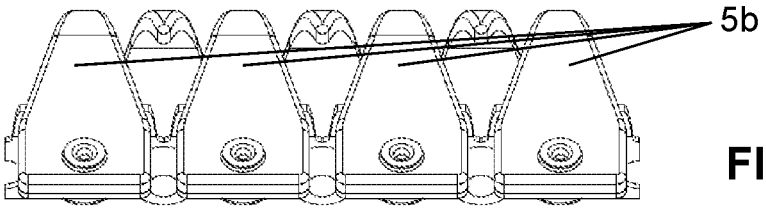
FIG. 6*c* shows a view of the contact part according to FIG. 6*a* from the side.
Figure 6D:
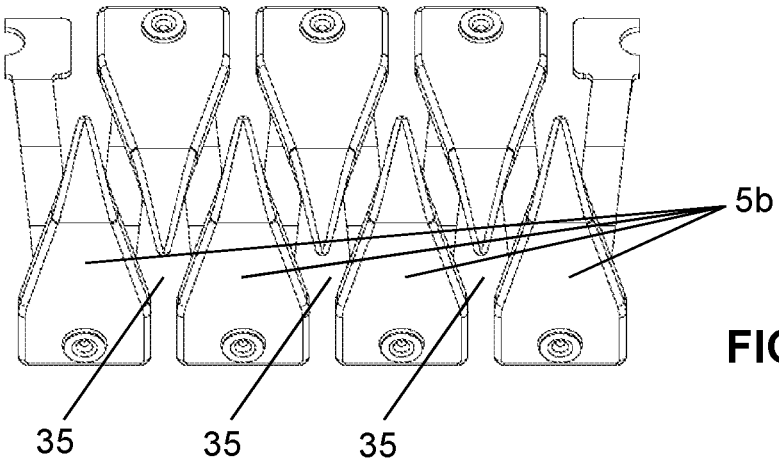
FIG. 6*d* shows a view of the contact part according to FIG. 6*a* from above.
Figure 6E:
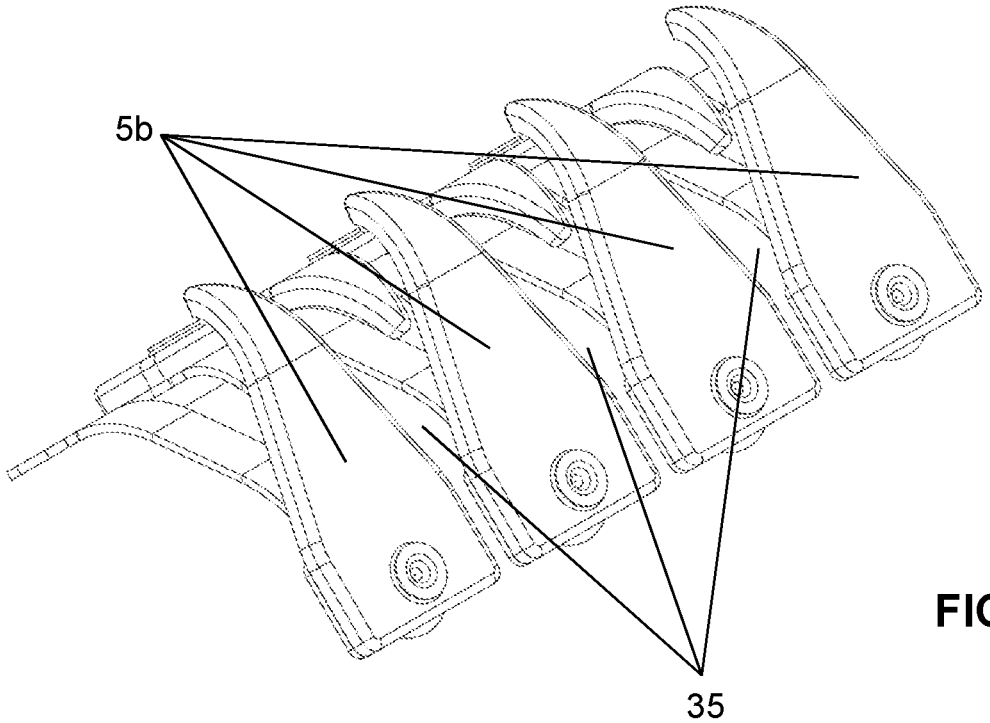
FIG. 6*e* shows a perspective view of the contact part according to FIG. 6*a* from above.
Figure 6F:
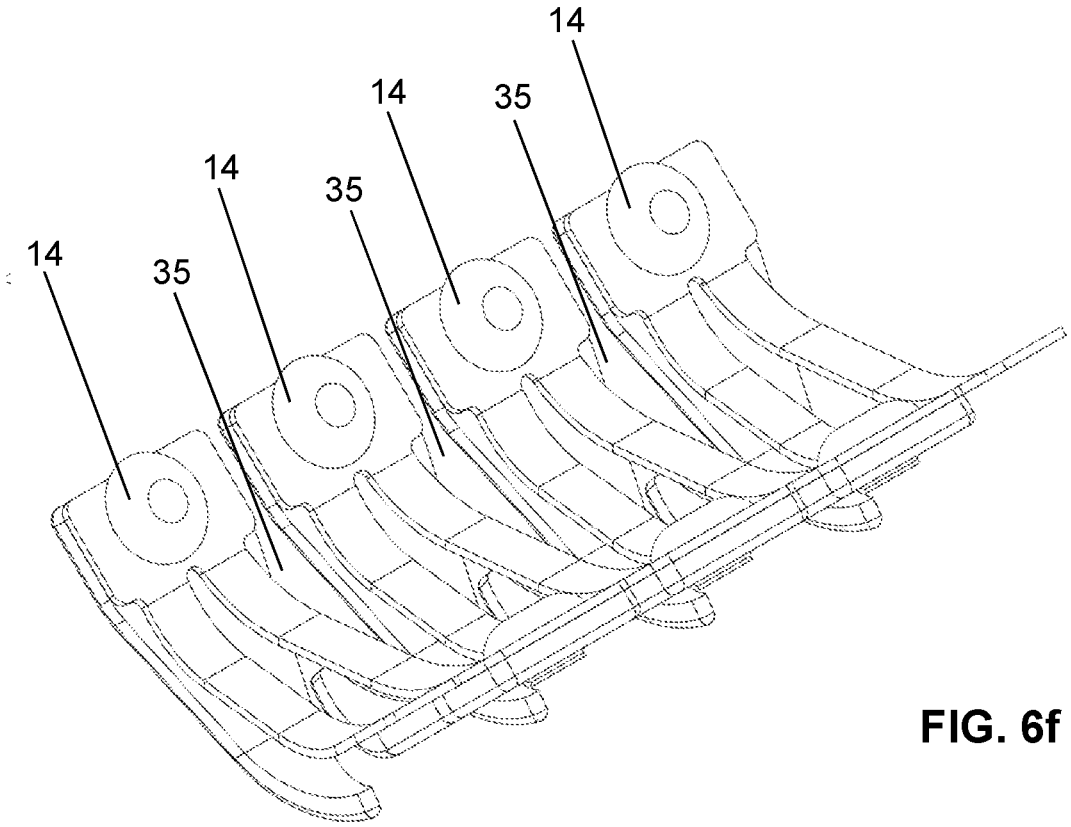
FIG. 6*f* shows a perspective view of the contact part according to FIG. 6*a* from below.

In FIG. 3, the carrier strip 2, to which the contact parts 5 are fastened, is shown in detail. The carrier strip 2 is designed in such a way that, when a force F is applied to the carrier strip 2 in the longitudinal direction L, said carrier strip is compressed or extended. The carrier strip 2 is therefore designed in a manner such that its length can be changed. The change in the length of the carrier strip 2 is preferably performed in the elastic region. The force F is symbolized as a double-headed arrow in FIG. 3.

In the embodiment shown, the carrier strip 2 comprises a plurality of fastening lugs 3. In this case, the fastening lugs 3, as seen in the longitudinal direction L, are arranged at a distance A in relation to one another. Two rows of fastening lugs 3 are provided in the embodiment shown. One row comprises first fastening lugs 3*a* that are arranged one behind the other in the longitudinal direction L, and the other row comprises second fastening lugs 3*b* that are likewise arranged one behind the other in the longitudinal direction L. The two rows therefore extend in the longitudinal direction L, wherein the rows are at a distance in relation to one another in a transverse direction Q that runs transverse in relation to the longitudinal direction. The distance between the fastening lugs 3 is identical in both rows. However, the first fastening lugs 3*a* are arranged offset by an offset B in relation to the second fastening lugs 3*b* in the longitudinal direction L. The offset B can correspond, for example, to half the distance A.

The figures show a symmetrical arrangement of the fastening lugs 3 with respect to the longitudinal direction L. An asymmetrical arrangement is likewise conceivable.

A line M is situated between the row of first fastening lugs 3*a* and the row of second fastening lugs 3*b*, which likewise extends in the longitudinal direction L. In this case, the line M can be a center line M. The first fastening lugs 3*a* and the second fastening lugs 3*b* are at a transverse distance C in relation to the line M with respect to the transverse direction Q.

The contact parts 5 are fastened to the carrier strip 2 at the fastening lugs 3. If the force F is now applied to the carrier strips, the distance A between the fastening lugs 3 changes and there is therefore also a change in the distance between the contact parts 5.

In the embodiment shown, in each case two fastening lugs 3 which immediately follow one another in the longitudinal direction L are connected to one another by means of a web 4. Here, the web 4 extends in a manner inclined at an angle α in relation to the longitudinal direction L. In the embodiment shown, a first web 4*a* extends from a first fastening lug 3*a* to a second fastening lug 3*b*. The web 4 is in each case formed on the inner edges 21 of the respective fastening lug 3*a*, 3*b*. In this case, the inner edge 21 is that edge of the fastening lug 3*a*, 3*b* which faces the respectively other fastening lug 3*b*, 3*a*. A second web 4*b* extends to a further first fastening lug 3*a*. In this case, the web 4*b* extends away from the same inner edge 21 of the second fastening lug 3*b* on which the first web 4*a* is formed on. The second web 4*b* is likewise inclined at an angle α in relation to the longitudinal direction L.

In other words: The webs 4*a*, 4*b* extend alternately from a fastening lug 3*a* in the first row to a fastening lug 3*b* in the second row, and vice versa. Due to such arrangement of the fastening lugs 3*a*, 3*b* and of the webs 4*a*, 4*b*, a meandering structure of the carrier strip 2 is achieved, which can be easily deformed in respect of its length.

This arrangement of the webs 4 and of the fastening lug 3 is then repeated many times over the longitudinal direction L, so that the actual carrier strip 2, which comprises a plurality of fastening lugs 3 and webs 4, can be provided.

If the force F is now applied in the longitudinal direction, the angle α reduces in the event of an extension of the carrier strip and, respectively, the angle α increases in the event of a compression of the carrier strip.

FIGS. 4*a* to 4*f* show a first embodiment, FIGS. 5*a* to 5*f* show a second embodiment, FIGS. 6*a* to 6*f* show a third embodiment, FIGS. 7*a* to 7*f* show a fourth embodiment, and FIGS. 8*a* to 8*f* show a fifth embodiment of a contact element 1 according to the invention.

The individual embodiments will now be explained in greater detail in the text that follows, wherein firstly the features that are the same in all embodiments and then features that are different will be explained.

FIGS. 4*a* to 8*f* clearly show that the contact parts 5 are fixedly connected to the fastening lug 3 of the carrier strip 2.

According to all of the embodiments, the contact parts 5 each comprise a first contact section 6 for making contact with one of the two contact pieces K2, K1, a second contact section 7 for making contact with the other of the two contact pieces K2, K1, and also a fastening section 8 for fastening the contact part 5 to a fastening lug 3 of the carrier strip 2.

In all of the embodiments, in each case one first contact part 5*a*, by way of its fastening section 8, is connected to a first fastening lug 3*a*. A second contact part 5*b*, in each case by way of its fastening section 8, is connected to a second fastening lug 3*b*. The first contact part 5*a*, which is connected to the first fastening lug 3*a*, is oriented, by way of its first contact section 6, toward the second contact part 5*b*, which is connected to the second fastening lug 3*b*. The first contact section 6 therefore protrudes toward the second contact part 5*b*. Similarly, the second contact part 5*b*, which is connected to the second fastening lug 3*b*, is oriented, by way of its first contact section 6, toward the first contact part 5*a*, which is connected to the first fastening lug 3*a*. In this case, the contact parts 5*a*, 5*b* are arranged in such a way that the respective first contact sections 6 extend from the fastening lug 3*a*, 3*b* beyond the line M that extends centrally between the two fastening sections 3*a*, 3*b* in the longitudinal direction L. That is to say, the first contact sections 6 of the respective contact parts are situated at least partially on the other side with respect to the line M.

The contact parts 5, 5*a*, 5*b* are situated in relation to the carrier strip 2 in such a way that the contact parts 5, 5*a*, 5*b* can be pivoted about a pivot line S that is situated parallel in relation to the line M. This in particular is clearly shown in FIGS. 4*a*, 5*a*, 6*a*, 7*a* and 8*a*. The pivot line S is oriented at a right angle in relation to the surface of the drawing sheet here. When contact is made by the first contact piece K1, the contact part 5 is pivoted, as illustrated in FIGS. 1 and 2, and the pivot movement according to arrow S'.

In addition to the pivoting movement S', the contact part 5 can also move relative on the contact face 18, 19 of the corresponding contact piece K1, K2 during the pivoting movement about the pivot line S. For this, the contact part 5 moves, together with the second contact section 7, relative to the second contact piece K2. This movement runs transverse to the pivot line S and is provided with reference symbol V.

FIGS. 4*a*, 5*a*, 6*a*, 7*a* and 8*a* further clearly show that the first contact part 5*a*, as seen from its fastening lug 3*a*, extends in such a way that the first contact section 6, as seen transverse to the longitudinal direction, extends beyond a second contact part 5*b*. The excess length is indicated by the arrow D. In doing so, the first contact part 5*a* extends beyond the second contact part 5*b* in such a way that, in the event of a contact movement from the side of the second contact part 5*b*, contact is first made with the first contact part 5*a* by the corresponding contact piece. Looking at FIGS. 4*a*, 5*a*, 6*a*, 7*a* and 8*a*, this means, when a contact piece is pushed toward the contact element 1 in the direction of arrow P', the contact piece first comes into contact with the first contact part 5*a*, before the contact piece comes into contact with the second contact part 5*b*.

The function of the contact element can be optimized due to the excess. For example, the maximum insertion force can be optimized in respect of the required installation space.

In other words, the first contact section 6 of the first contact part 5*a* protrudes beyond the top side 22 of the second contact part 5*b*. It goes without saying that the second contact part 5*b* is also arranged in this manner. Namely, the first contact section 6 of the second contact part 5*b* is arranged in such a way that it protrudes beyond the top side 22 of the first contact part 5*a*, specifically in such a way that, in the event of a contact movement from the side of the first contact part 5*a*, contact is first made with the second contact part 5*b* by the contact piece. This movement is symbolized by the arrow P in FIG. 4*a*.

FIGS. 4*a*, 5*a*, 6*a*, 7*a* and 8*a* additionally show that the webs 4 are designed such that they are bent once or bent several times about a line M that is situated between the fastening lugs 3*a*, 3*b*, so that the surface 24 of the fastening lugs 3*a*, which are arranged on one side of the line M, are situated in a manner inclined at an angle in relation to the surface 24 of the fastening lugs 3*b* that are arranged on the other side of the line M. The bending spot is in each case provided with the reference symbol 23 and the angle between the first fastening lugs 3*a* and the second fastening lugs 3*b* is indicated by β.

FIGS. 4*c*, 5*c*, 6*c*, 7*c* and 8*c* additionally show that in each case one second contact part 5*b* extends into the intermediate space Z1, Z2 that is situated between two adjacent first contact parts 5*a*. A first contact part 5*a* extends between two second contact parts 5*b* that are arranged adjacent to one another into the intermediate space Z2. An interleaved structure is therefore produced.

In all of the embodiments according to FIGS. 4*a* to 8*f*, the first contact section 6 of the contact part 5, 5*a*, 5*b* forms a free end 9 that protrudes from the carrier strip 2. The free end 9 is therefore not situated on the carrier strip 2, but rather extends away from the carrier strip 2 from the fastening section 8.

In the deflected state, the free end 9 can protrude through the carrier strip 2 through a recess 35 in the carrier strip 2. The recess 35 is preferably provided by the intermediate region between two webs 4.

The fastening section 8 abuts flat against the carrier strip 2.

Depending on the type of fastening of the contact part 5, 5*a*, 5*b*, the second contact section 7 is likewise a free end or abuts on the bottom side 25 of the carrier strip 2. This will be discussed further below in the context of the fastening of the contact parts 5, 5*a*, 5*b*.

In the embodiment according to FIGS. 4*a* to 4*f*, the second contact section 7 of the contact part 5, 5*a*, 5*b* is arranged in relation to the carrier strip 2 in such a way that the carrier strip 2 is not connected to the contact piece K2 in the contact position. The second contact section 7 is designed as a kind of raised portion 29 and is situated at a distance from the bottom side of the carrier strip 2.

In all of the embodiments according to FIGS. 4*a* to 8*f*, the contact part 5 is designed with a rounded portion 11 in the first contact section 6. The rounded portion 11 relates, in particular, to the top side 22 of the contact part in the first contact section 6, because the contacting with the respective contact faces K1, K2 is also made by means of the top side 22. Depending on the design, the bottom side 26 of the contact part 5, 5*a*, 5*b* can also be rounded. The rounded portion 11 extends around a rounded portion axis R11 with a constant or changing rounded portion radius. The rounded portion axis R11 preferably extends parallel in relation to the longitudinal direction L.

In the embodiments of FIGS. 4*a*-4*f*, 5*a*-5*f*, 7*a*-7*f* and 8*a*-8*f*, the second contact section 7 of the contact part 5, 5*a*, 5*b* is also designed in a rounded manner with a rounded portion 12. The rounded portion 12 extends around a rounded portion axis R12 with a constant or changing rounded portion radius. The rounded portion axis R12 preferably extends parallel in relation to the longitudinal direction L.

In the third embodiment according to FIGS. 6*a*-6*f*, the second contact section 7 is not provided directly by the contact part 5, 5*a*, 5*b*, but rather by a rivet 14, this being discussed yet further in the text that follows. In this case, the surface of the rivet 14 is designed with the rounded portion 12.

In the embodiments of FIGS. 4*a* to 8*f*, the second contact section 7 is situated in the region of the fastening section 8. That is to say, the second contact section 7 and the fastening section 8 are situated physically close to one another. The contact part 5, 5*a*, 5*b* is designed with a rounded portion 12 in the second contact section 7, which rounded portion 12 extends around a rounded portion axis R12 that runs parallel in relation to the longitudinal direction L, wherein the rounded portion axis R12 and the pivot line S run in a substantially collinear manner in relation to one another.

Figure 7A:
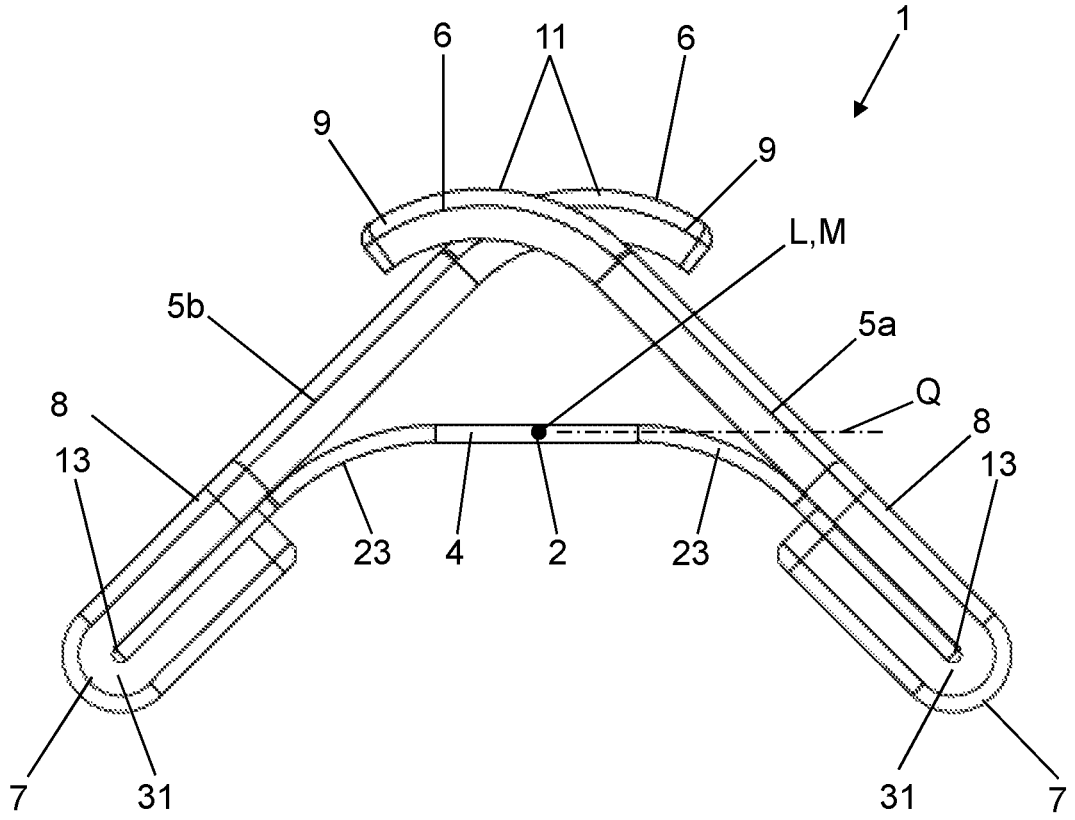
FIG. 7*a* shows a front view of a contact part according to a fourth embodiment of the present invention.
Figure 7B:
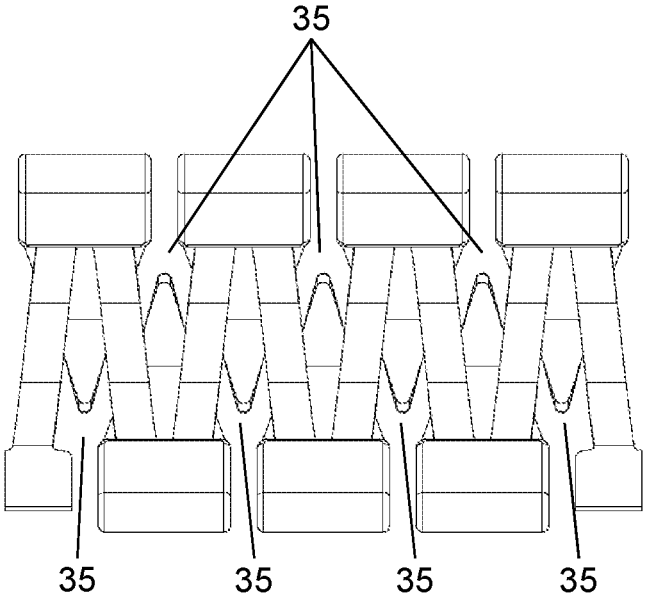
FIG. 7*b* shows a view of the contact part according to FIG. 7*a* from below.
Figure 7C:
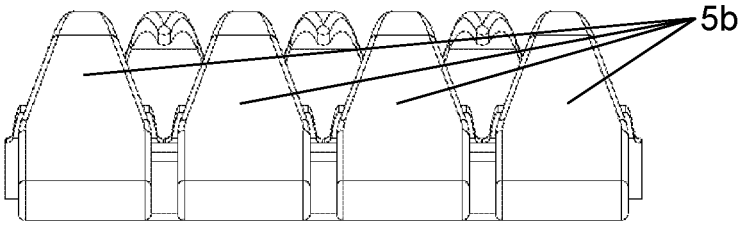
FIG. 7*c* shows a view of the contact part according to FIG. 7*a* from the side.
Figure 7D:
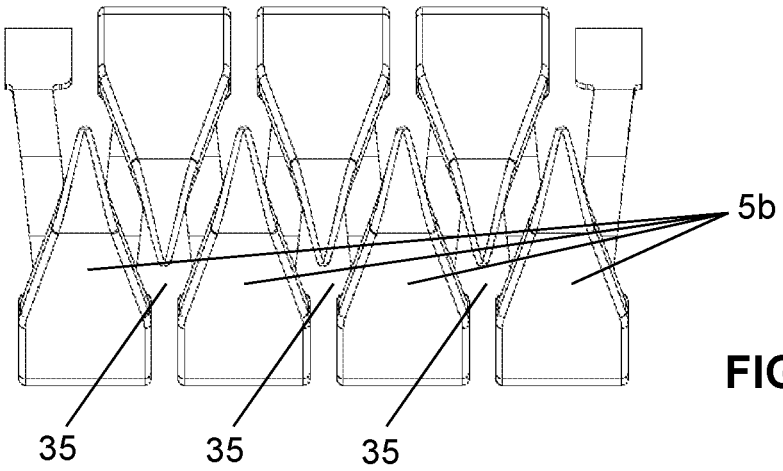
FIG. 7*d* shows a view of the contact part according to FIG. 7*a* from above.
Figure 7E:
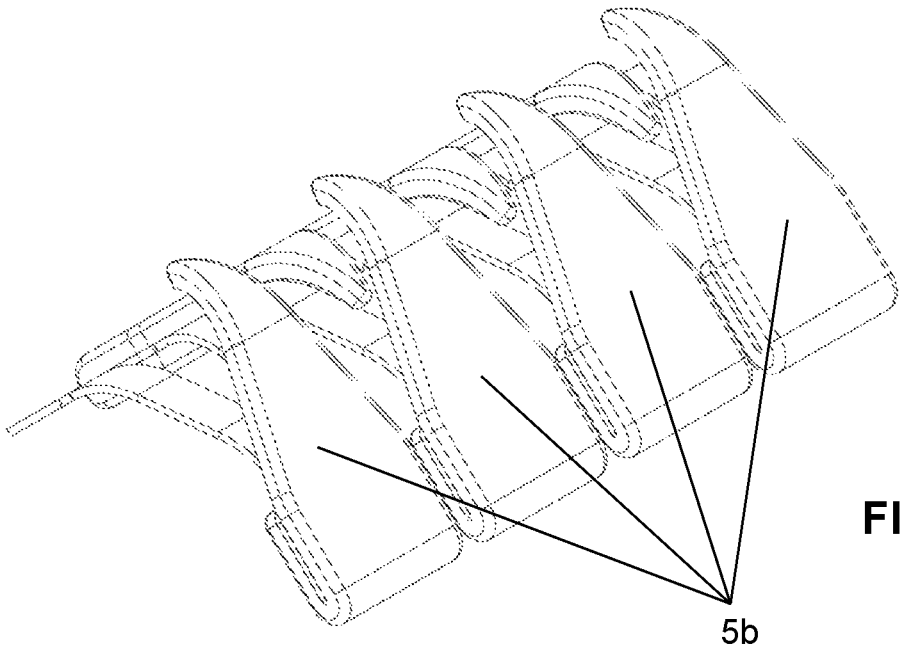
FIG. 7*e* shows a perspective view of the contact part according to FIG. 7*a* from above.
Figure 7F:
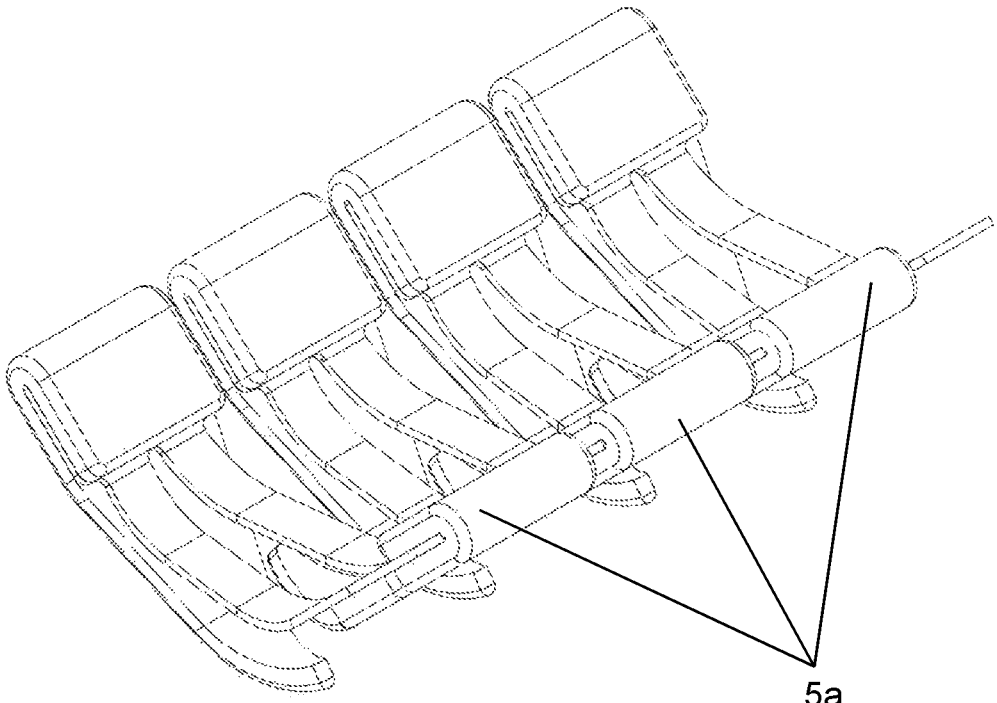
FIG. 7*f* shows a perspective view of the contact part according to FIG. 7*a* from below.
Figure 8A:
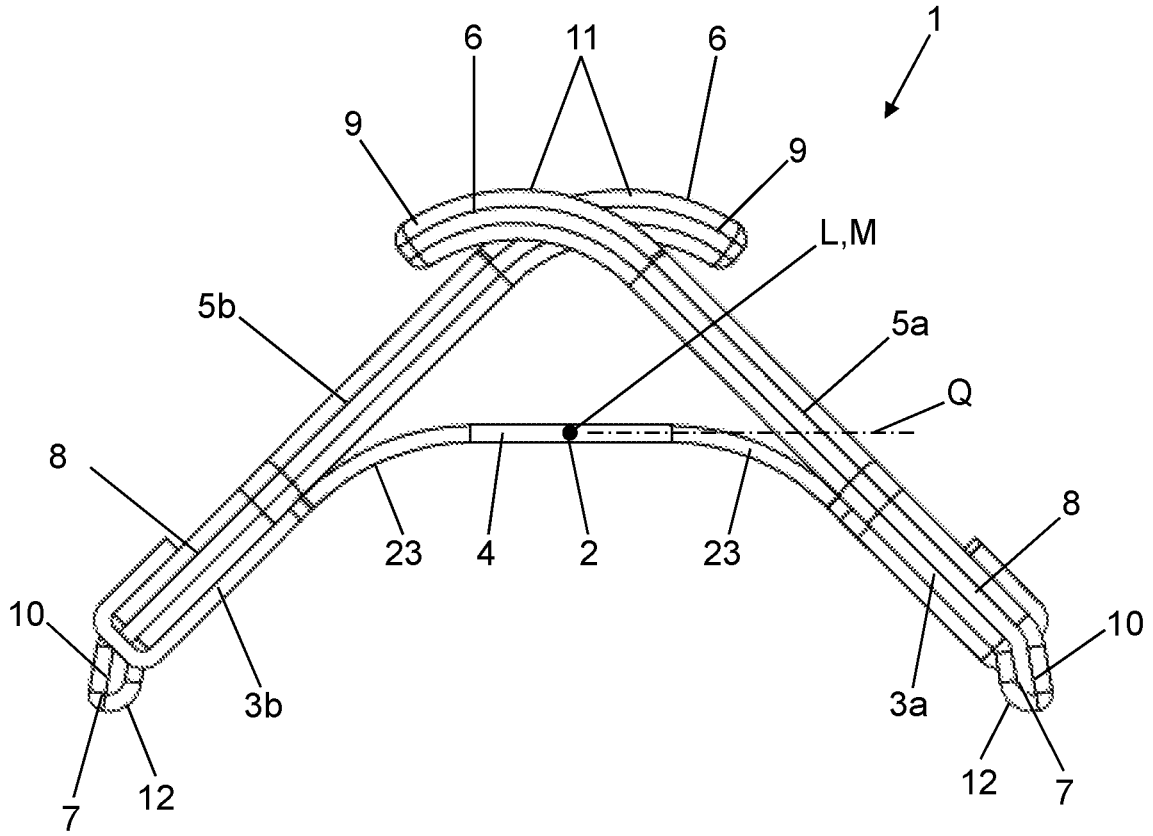
FIG. 8*a* shows a front view of a contact part according to a fifth embodiment of the present invention.
Figure 8E:
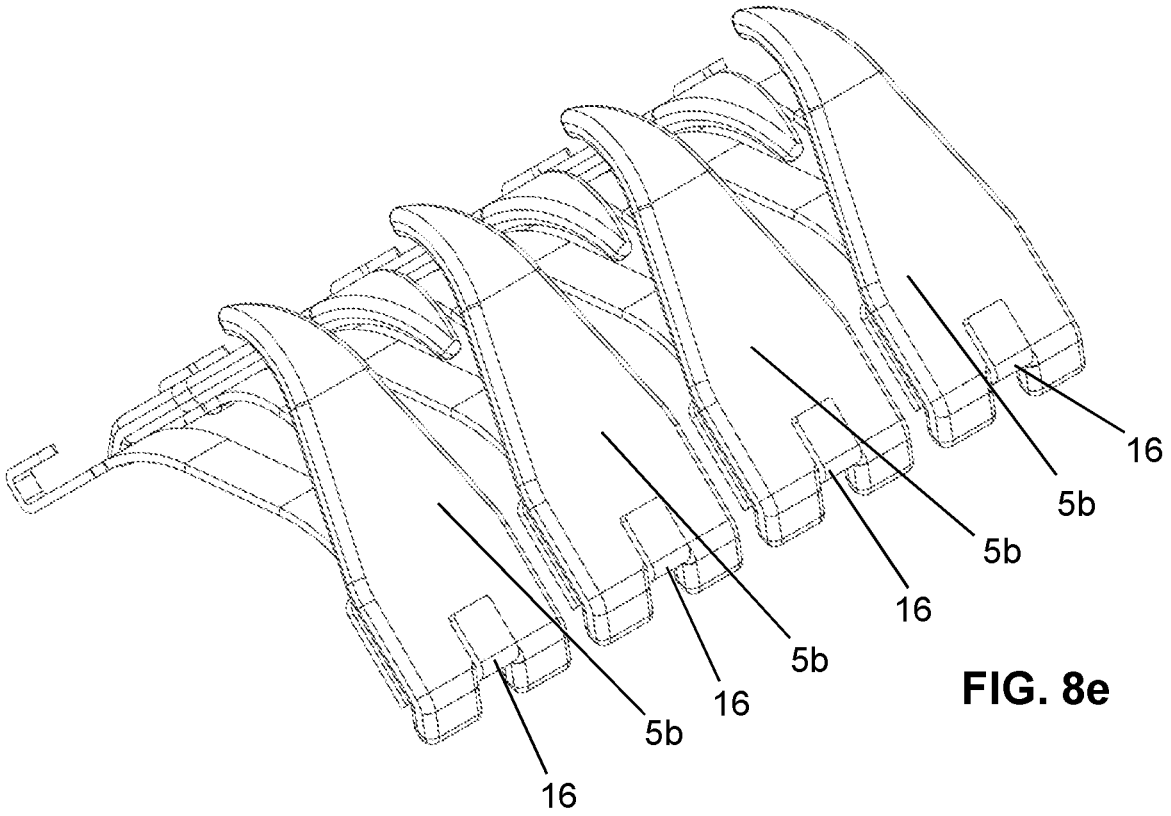
FIG. 8*e* shows a perspective view of the contact part according to FIG. 8*a* from above.
Figure 8F:
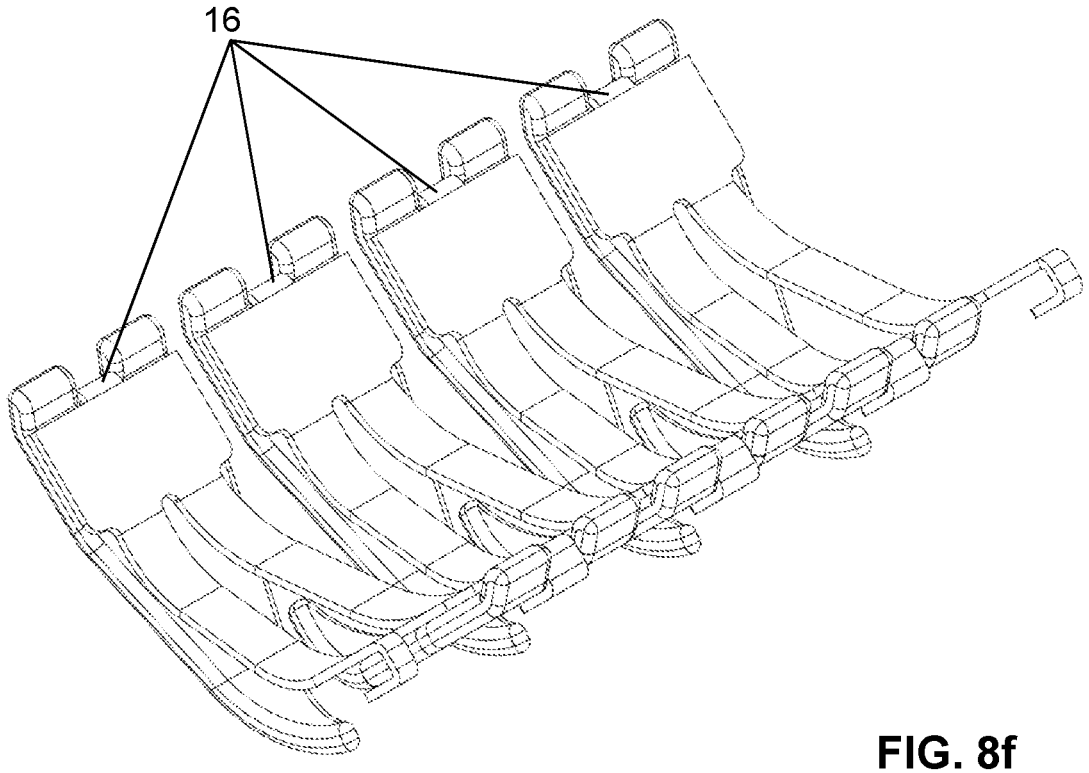
FIG. 8*f* shows a perspective view of the contact part according to FIG. 8*a* from below.

In the embodiments of FIGS. 7*a* and 8*a*, the second contact section 7 surrounds the carrier strip in the region of its outer edge 13.

In all of the embodiments, the rounded portion radius R11 of the rounded portion 11 of the first contact section 6 can be different from the rounded portion radius R12 of the rounded portion 12 of the second contact section 7. The rounded portion radii R11, R12 can also be the same.

In all of the embodiments, the cross section of the contact part 5, 5*a*, 5*b* in the region of the fastening section 8 is larger than in the region of the first contact section 6. The first contact section 6 is therefore designed in a tapered manner in relation to the fastening section 8. The change in cross section can have different geometries.

In the embodiments of FIGS. 4*a*-4*f* and 8*a*-8*f*, the cross section of the contact part 5, 5*a*, 5*b* as seen in the region of the fastening section 8 is larger than the cross section of the contact part 5, 5*a*, 5*b* in the region of the second contact section 7. The second contact section 7 is therefore designed in a tapered manner in relation to the fastening section 8. The change in cross section can have different geometries. However, the degree of taper in the second contact section 7 is preferably smaller than in the first contact section 6.

In the embodiments of FIGS. 5*a*-5*f*, 6*a*-6*f* and 7*a*-7*f*, the cross section of the contact part 5, 5*a*, 5*b* in the region of the fastening section 8 is substantially equal to the cross section in the region of the second contact section 7.

In the first embodiment according to FIGS. 4*a* to 4*f*, the contact part 5, 5*a*, 5*b* is connected to the carrier strip 2 by way of at least one rivet 15. At least one rivet 15 is formed in one piece with the contact part 5, 5*a*, 5*b*. The contact part 3 and the rivet 15 therefore form a one-piece structure. The rivet 15 is then plastically deformed in the region of the bottom side 25 of the carrier strip, so that a rivet head 27 is formed, with which rivet head the carrier strip 2 is clamped to the contact part 5, 5*a*, 5*b*. The rivet 15 protrudes through the carrier strip 2 through a rivet opening 33. The rivet 15 and also the rivet opening 33 have substantially the same cross section and are here of oval design.

In the shown embodiment according to FIGS. 4*a* to 4*f*, four rivets 15 are provided for each contact part 5, 5*a*, 5*b*. In other variants of the first embodiment, the number of rivets 15 can also be larger than or less than four.

The rivets 15 according to the first embodiment are preferably produced by a stamping process, wherein a stamping tool plastically deforms the fastening section from the top side 22 and in this way presses out the rivets from the bottom side 26 of the contact element.

The fastening lugs 3 have apertures for receiving the rivets 15. The number of apertures and the position thereof is matched to the number and to the position of the rivets 15. The apertures in the carrier strip are produced, for example, by a punching process.

In the first embodiment, the second contact section 7 has an optional indentation 28 that, as seen centrally through the second contact section 7 and transverse in relation to the longitudinal direction L, extends into the second contact section 7. A defined division of the contact faces can be achieved by way of the indentation 28, as a result of which the contact resistance is definable in a more precise manner.

The contact part 5 further comprises a raised portion 29 in the region of the outer edge 13 of the fastening lug 3. The second contact section 7 then adjoins the raised portion 29. Owing to the raised portion 29, the fastening section 8 is situated in a manner offset to the rear from the contact section 7, so that the fastening lug 3 and the rivet head 27 are likewise offset from the contact section 7 in such a way that they do not have a negative influence on the contacting process.

In the second embodiment according to FIGS. 5*a* to 5*f*, the contact part 5, 5*a*, 5*b* is connected to the carrier strip 2 by way of at least one rivet 14.

The rivet 14 of this embodiment is designed separately from the contact part 5, 5*a*, 5*b*. The rivet 14 is routed through an aperture in the second contact section 8 and through an aperture in the fastening lug 3. The contact part 5, 5*a*, 5*b* is clamped to the fastening lug 3 by way of the rivet 14.

In the shown embodiment only one rivet 14 is shown. The provision of several rivets 14, as shown for example in FIG. 4, would also be conceivable.

In the second embodiment, the second contact section 7 adjoins the fastening section 8 opposite the first contact section 6. In this case, the second contact section 7 is designed in a manner bent from the fastening section 8 by means of a bend spot 30 and runs in a manner inclined at an angle in relation to the fastening section.

In this embodiment, the first contact section 6 is designed as a rounded tip with the above-described rounded portion, wherein the tip tapers toward the free end 9.

The fastening by way of the at least one rivet 14 could be assisted by way of a welded or soldered connection, in addition to the mechanical fastening. The rivet 14 could thus be welded or soldered.

In the third embodiment according to FIGS. 6*a* to 6*f*, the contact part 5, 5*a*, 5*b* is connected to the carrier strip 2 by way of at least one rivet 14.

The rivet 14 of this embodiment is designed separately from the contact part 5, 5*a*, 5*b*. The rivet 14 is routed through an aperture in the second contact section 8 and through an aperture in the fastening lug 3. The contact part 5, 5*a*, 5*b* is clamped to the fastening lug 3 by way of the rivet 14.

In the embodiment shown, only one rivet 14 is displayed. The provision of several rivets 14, as for example shown in FIG. 4, would also be conceivable.

According to the third embodiment, the rivet 14 is provided from an electrically conductive material, and the rivet head 27 on the bottom side 26 of the carrier strip 2 provides the second contact section. The rivet 14 is in electrical contact with contact part 5, 5*a*, 5*b*.

In the embodiment shown, the rivet head 27 protrudes beyond the outer edge 13 of the fastening lug 3, so that good contacting with the contact face of the second contact piece is achieved.

The rivet head 27 has the above-described rounded portion 12.

In a further embodiment, which substantially corresponds to the combination of the first and the third embodiment, the rivet is formed in one piece with the contact part, as in the case of the first embodiment, and the rivet head is then reshaped, according to the third embodiment, so that the rivet head can provide said second contact section. This further embodiment is not illustrated in the figures.

In this embodiment, the first contact section 6 is designed as a rounded tip with the above-described rounded portion, wherein the tip tapers toward the free end 9.

The fastening by way of the at least one rivet 14 could be assisted by way of a welded or soldered connection, in addition to the mechanical fastening. The rivet 14 could therefore be welded or soldered.

In the fourth embodiment according to FIGS. 7*a* to 7*f*, the fastening section 8 at least partially surrounds the fastening lug 3. In the embodiment shown, the fastening section 8 surrounds the fastening lug on its top side as well as on its bottom side and the outer edge 13. When the contact part 3 is mounted, the fastening section 8 is plastically reshaped and thereby clamped to the fastening lug. The mechanical clamping can be assisted by an additional soldered or welded connection.

The fastening section preferably substantially completely surrounds the top side resp. the bottom side of the fastening plug. It would also be conceivable that the fastening section only partially surrounds the top side and/or the bottom side.

The clamping can also be called crimping or a crimped connection. In the figures, the crimping is provided with reference symbol 31.

That part of the fastening section 8 that extends around the outer edge 13 at the same time serves as a second contact section 7 and is accordingly designed with a rounded portion 12 on its outer side.

In the fifth embodiment according to FIGS. 8*a* to 8*f*, the contact part 5, 5*a*, 5*b* is fastened to the fastening lug 3 by way of a clip element 16. In the embodiment shown, the clip element 16 is formed on the fastening lug 3 and extends away from the outer edge 13 of the fastening lug 3 transverse in relation to the longitudinal direction L. The clip element 16 is reshaped and extends to the top side 22 of the contact part 5, 5*a*, 5*b* in the region of the fastening section 8 and thereby clamps the contact part 5, 5*a*, 5*b* to the fastening lug 3.

As an alternative, the clip element 16 can also be an element that is separate from the contact part or from the fastening lug 3.

The clip element 16 preferably extends through a slot 17 that extends into the second contact section 7. This ensures that the clip element does not have a negative influence on the contacting between the second contact section 7 and the second contact piece K2. In other words, the contact section 7 extends away from the fastening section 8 as a second free end.

The mechanical clamping by the clip elements 16 can be assisted by an additional soldered or welded connection.

FIGS. 9*a* to 9*d* show a schematic view of a first installation situation of a contact element 1. In this case, the contact element 1 can be designed in accordance with the present invention, in particular according to the preceding embodiments.

Here, the longitudinal direction of the carrier strip 2 resp. the line M extend around a center axis X. FIGS. 9*a* to 9*d* substantially show the installation situation in a socket, wherein the second contact sections 7 are then situated in a groove in a socket.

Figure 9A:
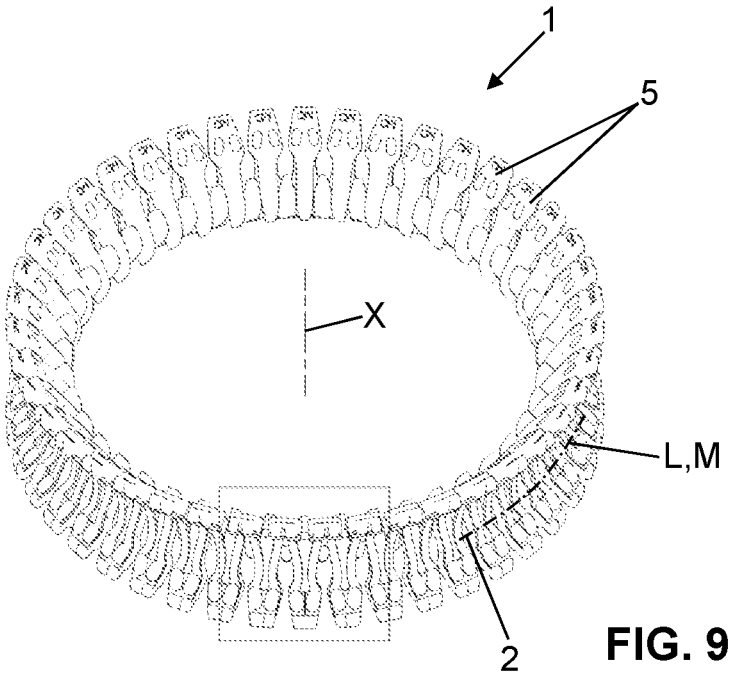
FIG. 9*a* shows a schematic view of a contact part according to the invention for arranging in a circumferential groove in a socket.
Figure 9B:
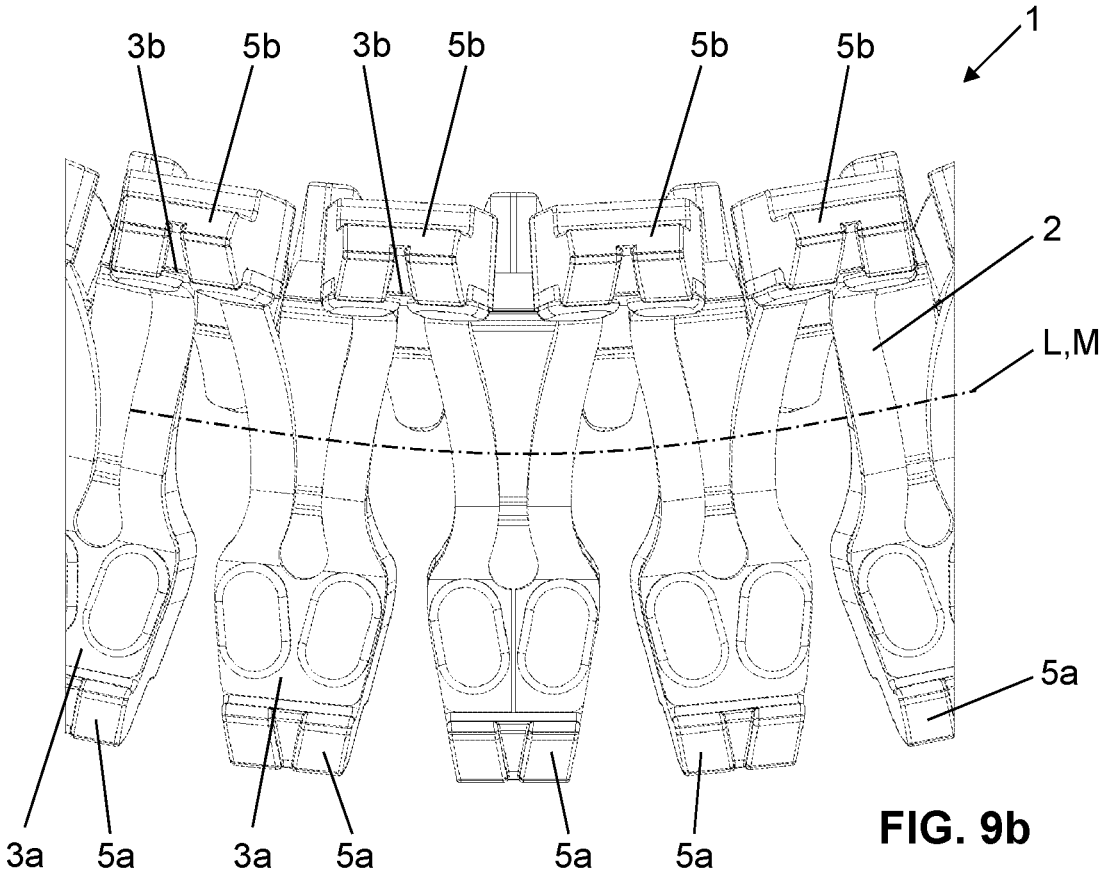
FIG. 9*b* shows a view of a detail of FIG. 9*a;*
Figure 9C:
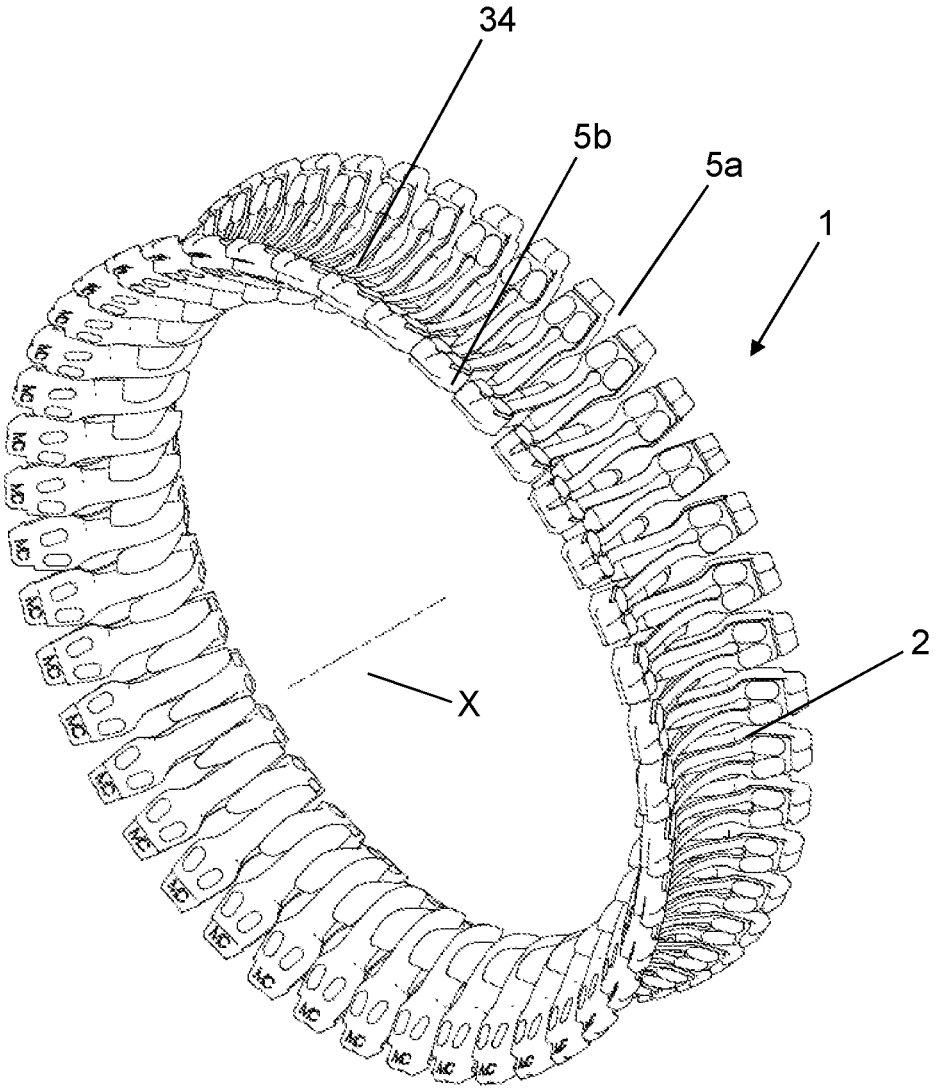
FIG. 9*c* shows a perspective view of a detail of FIG. 9*a;*

In particular, FIG. 9*c* clearly shows that the orientation of the contact parts 5 is in the direction of the center axis X, that is to say transverse in relation to the longitudinal direction of the carrier strip.

FIGS. 10*a* to 10*d* show a schematic view of a second installation situation of a contact element 1. In this case, the contact element 1 can be designed in accordance with the present invention, in particular according to the preceding embodiments.

Here, the longitudinal direction of the carrier strip 2 resp. the center line M extend around a center axis X. FIGS. 10*a* to 10*d* substantially show the installation situation on the outer side of a plug, wherein the second contact sections 7 are then situated in a groove in a socket.

Figure 10A:
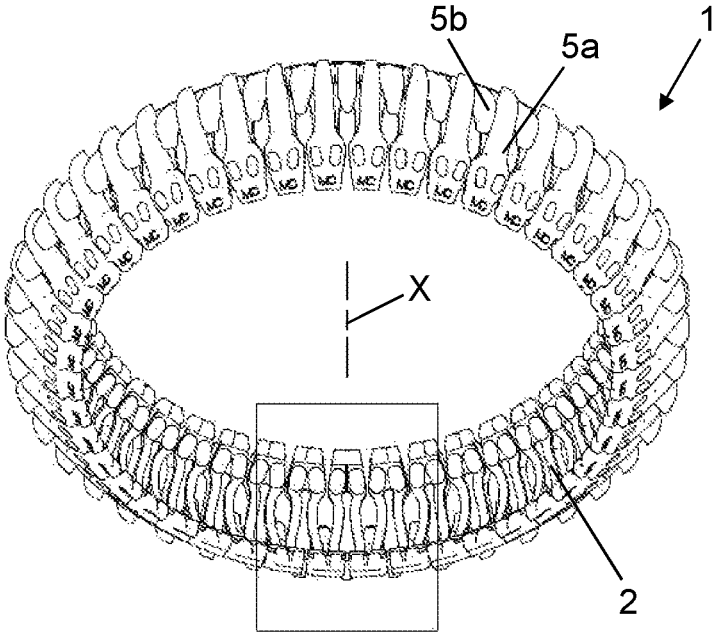
FIG. 10*a* shows a schematic view of a contact part according to the invention for arranging in a circumferential groove in a pin.
Figure 10B:
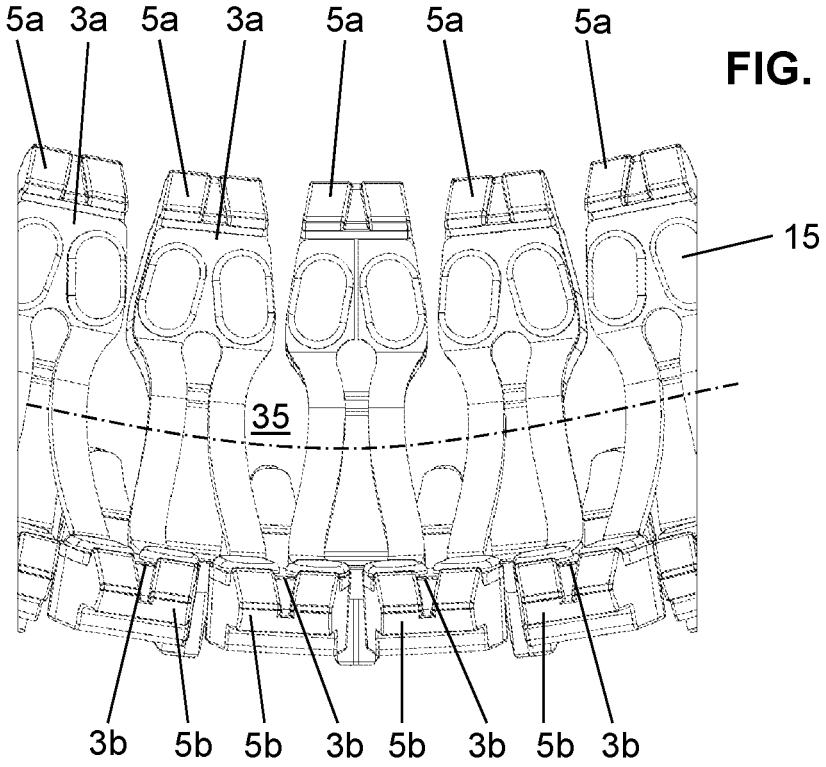
FIG. 10*b* shows a view of a detail of FIG. 10*a*.
Figure 10C:
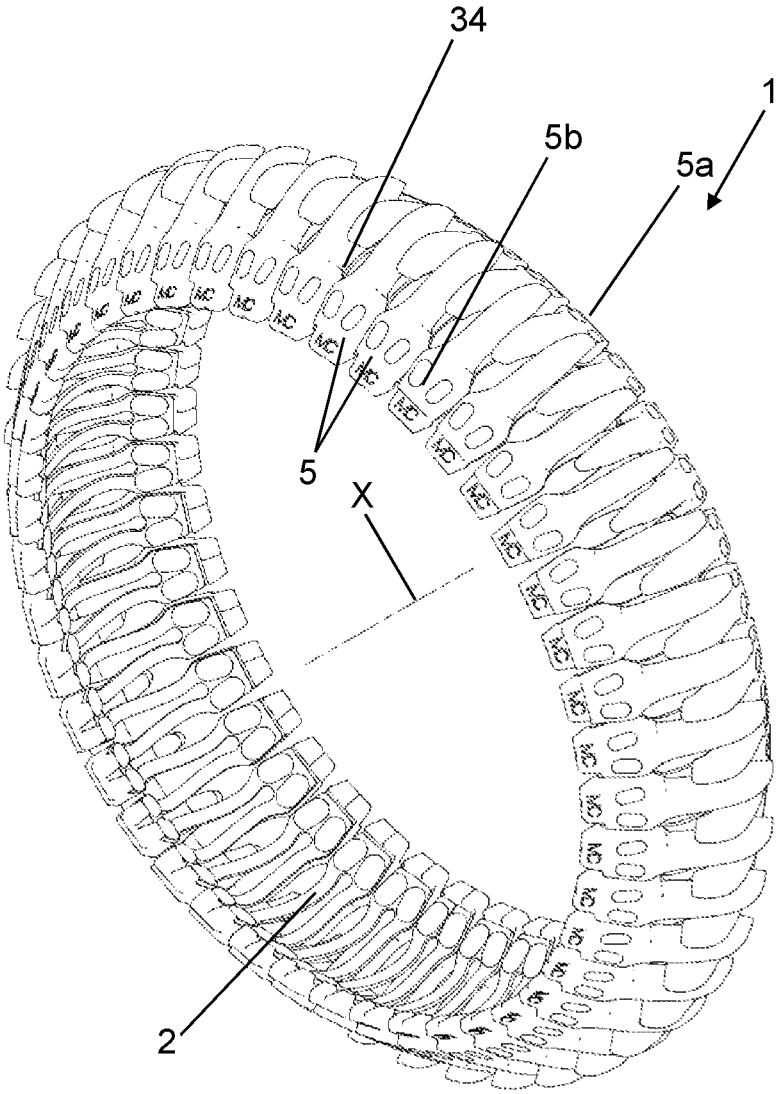
FIG. 10*c* shows a perspective view of a detail of FIG. 10*a*.

FIG. 10C in particular clearly shows that the orientation of the contact parts 5 is in the direction of the center axis X, that is to say transverse in relation to the longitudinal direction of the carrier strip.

In the case of both configurations according to FIGS. 9*a* to 9*c* and 10*a* to 10*c*, the ends 34 of the carrier strip 2 are connected to one another, so that the result is a contact element that extends around a center axis X, wherein the two ends 34 are preferably connected to one of said contact parts 5, 5*a*, 5*b*.

LIST OF REFERENCE SIGNS

| | |
|---|---|
| 1 | Contact element |
| 2 | Carrier strip |
| 3, 3a, 3b | Fastening lugs |
| 4 | Web |
| 5, 5a, 5b | Contact part |
| 6 | First contact section |
| 7 | Second contact section |
| 8 | Fastening section |
| 9 | Free end |
| 10 | Free end |
| 11 | Rounded portion |
| 12 | Rounded portion |
| 13 | Outer edge |
| 14 | Rivet |
| 15 | integrally formed rivet |
| 16 | Clip element |
| 17 | Slot |
| 18 | Contact face |
| 19 | Contact face |
| 20 | Rounded portion of the contact face 18 |
| 21 | Inner edge |
| 22 | Top side |
| 23 | Bending spot |
| 24 | Surface |
| 25 | Bottom side |
| 26 | Bottom side |
| 27 | Rivet head |
| 28 | Indentation |
| 29 | Raised portion |
| 30 | Bend spot |
| 31 | Crimping |
| 33 | Rivet opening |
| 34 | Ends |
| 35 | Recess |
| A | Distance |
| B | Offset |
| C | Transverse distance |
| D | Excess length |
| L | Longitudinal direction |
| Q | Transverse axis |
| M | Center line |
| P, P' | Arrow |
| S | Pivot line |
| X | Center axis |
| Z1 | Intermediate space |
| Z2 | Intermediate space |
| F | Force |
| E | Plane |
| R11 | Rounded portion axis |
| R12 | Rounded portion axis |
| K1 | Contact piece |
| K2 | Contact piece |

The invention claimed is:

1. A contact element for establishing electrical contact between two contact pieces, comprising:

a carrier strip that extends in a longitudinal direction, wherein the carrier strip is designed in such a way that, when a force is applied to the carrier strip, the length of the carrier strip changes in the longitudinal direction, and a plurality of contact parts each having at least one first contact section for making contact with one of the two contact pieces, at least one second contact section for making contact with the other of the two contact pieces, and also having at least one fastening section for fastening the contact part to a fastening spot at the carrier strip.

2. The contact element according to claim 1, wherein a line, in particular a center line, extends centrally through the carrier strip in the longitudinal direction, and wherein the contact parts are situated in relation to the carrier strip in such a way that the contact parts can be pivoted about a pivot line, which pivot line is situated in a manner angularly inclined at an angle of less than 30°, in particular substantially parallel, in relation to said line.

3. The contact element according to claim 1, wherein the fastening spots of the carrier strip are provided by a plurality of fastening lugs that are spaced at a distance in relation to one another in the longitudinal direction, wherein, when said force is applied to the carrier strip in the longitudinal direction, a relative displacement of the fastening lugs in relation to one another is possible, and wherein the contact parts are fastened to the fastening lug of the carrier strip by means of the fastening section.

4. The contact element according to claim 1, wherein the fastening spots of the carrier strip are provided by a plurality of fastening lugs that are spaced at a distance in relation to one another in the longitudinal direction, wherein, when said force is applied to the carrier strip in the longitudinal direction, a relative displacement of the fastening lugs in relation to one another is possible, wherein the contact parts are fastened to the fastening lug of the carrier strip by means of the fastening section and wherein each two fastening lugs that follow one another in the longitudinal direction are connected to one another by means of a web, and wherein the web is preferably angularly inclined at an angle in relation to the longitudinal direction.

5. The contact element according to claim 1, wherein the fastening spots of the carrier strip are provided by a plurality of fastening lugs that are spaced at a distance in relation to one another in the longitudinal direction, wherein, when said force is applied to the carrier strip in the longitudinal direction, a relative displacement of the fastening lugs in relation to one another is possible, wherein the contact parts are fastened to the fastening lug of the carrier strip by means of the fastening section and wherein each two fastening lugs that follow one another in the longitudinal direction are connected to one another by means of a web, wherein the web is preferably angularly inclined at an angle in relation to the longitudinal direction, wherein a center line extends centrally through the carrier strip in the longitudinal direction, wherein in each case one first fastening lug is arranged on a first side laterally in relation to the center line and in each case one second fastening lug is arranged on a second side laterally in relation to the center line, and wherein the web in each case connects a first fastening lug and a second fastening lug, and also a further web connects said second fastening lug to a further first fastening lug.

6. The contact element according to claim 1, wherein the fastening spots of the carrier strip are provided by a plurality of fastening lugs that are spaced at a distance in relation to one another in the longitudinal direction, wherein, when said force is applied to the carrier strip in the longitudinal direction, a relative displacement of the fastening lugs in relation to one another is possible, wherein the contact parts are fastened to the fastening lug of the carrier strip by means of the fastening section and wherein each two fastening lugs that follow one another in the longitudinal direction are connected to one another by means of a web, wherein the web is angularly inclined at an angle in relation to the longitudinal direction, wherein a center line extends centrally through the carrier strip in the longitudinal direction, wherein in each case one first fastening lug is arranged on a first side laterally in relation to the center line and in each case one second fastening lug is arranged on a second side laterally in relation to the center line, wherein the web in each case connects a first fastening lug and a second fastening lug, and also a further web connects said second fastening lug to a further first fastening lug, and wherein the first contact part that is connected to the first fastening lug is oriented, by way of a first contact section thereof, toward the second contact part that is connected to the second fastening lug and/or the second contact part that is connected to the second fastening lug is oriented, by way of a first contact section thereof, toward the first contact part that is connected to the first fastening lug.

7. The contact element according to claim 1, wherein the fastening spots of the carrier strip are provided by a plurality of fastening lugs that are spaced at a distance in relation to one another in the longitudinal direction, wherein, when said force is applied to the carrier strip in the longitudinal direction, a relative displacement of the fastening lugs in relation to one another is possible, wherein the contact parts are fastened to the fastening lug of the carrier strip by means of the fastening section and wherein each two fastening lugs that follow one another in the longitudinal direction are connected to one another by means of a web, wherein the web is preferably angularly inclined at an angle in relation to the longitudinal direction, wherein a center line extends centrally through the carrier strip in the longitudinal direction, wherein in each case one first fastening lug is arranged on a first side laterally in relation to the center line and in each case one second fastening lug is arranged on a second side laterally in relation to the center line, and wherein the web in each case connects a first fastening lug and a second fastening lug, and also a further web connects said second fastening lug to a further first fastening lug, wherein the first contact part that is connected to the first fastening lug is oriented, by way of a first contact section thereof, toward the second contact part that is connected to the second fastening lug and/or the second contact part that is connected to the second fastening lug is oriented, by way of a first contact section thereof, toward the first contact part that is connected to the first fastening lug, and wherein the first contact part, as seen from the first fastening lug, extends in such a way that the first contact section, as seen transverse in relation to the longitudinal direction, extends beyond a second contact part in such a way that, in the event of a contact movement from the side of the second contact part, the first contact part is first contacted by the contact piece.

8. The contact element according to claim 1, wherein the fastening spots of the carrier strip are provided by a plurality of fastening lugs that are spaced at a distance in relation to one another in the longitudinal direction, wherein, when said force is applied to the carrier strip in the longitudinal direction, a relative displacement of the fastening lugs in relation to one another is possible, wherein the contact parts are fastened to the fastening lug of the carrier strip by means of the fastening section and wherein each two fastening lugs that follow one another in the longitudinal direction are connected to one another by means of a web, wherein the web is preferably angularly inclined at an angle in relation to the longitudinal direction, wherein a center line extends centrally through the carrier strip in the longitudinal direction, wherein in each case one first fastening lug is arranged on a first side laterally in relation to the center line and in each case one second fastening lug is arranged on a second side laterally in relation to the center line, and wherein the web in each case connects a first fastening lug and a second fastening lug, and also a further web connects said second fastening lug to a further first fastening lug, wherein the first contact part that is connected to the first fastening lug is oriented, by way of a first contact section thereof, toward the second contact part that is connected to the second fastening lug and/or the second contact part that is connected to the second fastening lug is oriented, by way of a first contact section thereof, toward the first contact part that is connected to the first fastening lug, and wherein a second contact part extends into the intermediate space that is situated between two adjacent first contact parts and a first contact part extends into the intermediate space that is situated between two adjacent second contact parts.

9. The contact element according to claim 1, wherein the contact parts extend from the respective fastening spot, by way of which the corresponding contact part is connected to the carrier strip, beyond the center line, which extends in the longitudinal direction, and/or wherein contact parts are arranged on either side in relation to the carrier strip, and wherein there is an intermediate space between two contact parts that are arranged adjacent to one another on the same side into which a contact part that is arranged on the other side can protrude.

10. The contact element according to claim 1, wherein the webs are designed in a manner bent about a center line that is situated between the fastening spots or fastening lugs, in particular bent in a curved manner and/or bent once and/or bent several times, so that the surface of the fastening spots or fastening lugs, which are arranged on one side of the center line, is situated in a manner inclined at an angle in relation to the surface of the fastening spots or fastening lugs, which are arranged on the other side of the center line.

11. The contact element according to claim 1, wherein the first contact section forms a free end with respect to the carrier strip and protrudes away from or sticks out of the carrier strip at least in the non-deflected state, and wherein the free end protrudes through the carrier strip through a recess in the carrier strip in the contact position.

12. The contact element according to claim 1, wherein the contact part is designed with a rounded portion in the first contact section, which rounded portion extends around a rounded portion axis that runs parallel to the longitudinal direction, and/or wherein the contact part is designed with a rounded portion in the second contact section, which rounded portion extends around a rounded portion axis that runs parallel to the longitudinal direction.

13. The contact element according to claim 1, wherein the cross section of the contact part in the region of the fastening section is larger than the cross section of the contact part in the region of the first contact section.

14. The contact element according to claim 1, wherein the cross section of the contact part in the region of the fastening section is larger than the cross section of the contact part in the region of the second contact section, or wherein, as seen in the longitudinal direction, the cross section of the contact part in the region of the fastening section is substantially equal to the cross section in the region of the second contact section.

15. The contact element according to claim 1, wherein the second contact section of the contact part is situated in relation to the carrier strip in such a way that the carrier strip is not connected to the contact piece in the contact position.

16. The contact element according to claim 1, wherein the contact part is connected to the fastening spot or the fastening lug by means of the fastening section by way of at least one plastically deformable connecting element, in particular to at least one rivet, and wherein the connecting element is formed in one piece with the contact part.

17. The contact element according to claim 1, wherein the contact part is connected to the fastening spot or the fastening lug by means of the fastening section by way of at least one plastically deformable connecting element, in particular to at least one rivet, wherein the connecting element is formed in one piece with the contact part and wherein the connecting element or the rivet is composed of an electrically conductive material and is electrically conductively connected to the contact part, and wherein the second contact section can be provided by the connecting element or the rivet.

18. The contact element according to claim 1, wherein the contact part is connected to the fastening spot or the fastening lug in the fastening section by way of at least one rivet, and wherein the rivet protrudes through the fastening section and the fastening spot or the fastening lug of the carrier strip.

19. The contact element according to claim 1, wherein the contact part is connected to the fastening spot or the fastening lug in the fastening section by way of at least one rivet, wherein the rivet protrudes through the fastening section and the fastening spot or the fastening lug of the carrier strip and wherein the connecting element or the rivet is composed of an electrically conductive material and is electrically conductively connected to the contact part, and wherein the second contact section can be provided by the connecting element or the rivet.

20. The contact element according to claim 1, wherein the contact part, by way of the fastening section for fastening to the fastening spot or the fastening lug, at least partially surrounds the fastening spot or the fastening lug.

21. The contact element according to claim 1, wherein the contact part, by way of the fastening section for fastening to the fastening spot or the fastening lug, at least partially surrounds the fastening spot or the fastening lug, and wherein an outer edge of the fastening spot or the fastening lug, which outer edge runs parallel in relation to the longitudinal axis, and surfaces of the fastening spot or the fastening lug that adjoin said outer edge are at least partially surrounded or completely surrounded by the contact part.

22. The contact element according to claim 1, wherein the contact part, by way of a clip element, is fastened to the fastening spot or to the fastening lug, and wherein the clip element is preferably positioned in the region of a slot which extends into the second contact section.

23. The contact element according to claim 1, wherein the ends of the carrier strip are connected to one another, resulting in a contact element that extends around a center axis, wherein the two ends are preferably connected to one of said contact parts, or wherein the ends are connected to one another by way of a separate element.

24. An arrangement comprising a contact element and also a first contact piece and a second contact piece, wherein the contact element comprises a carrier strip that extends in a longitudinal direction, wherein the carrier strip is designed in such a way that, when a force is applied to the carrier strip, the length of the carrier strip changes in the longitudinal direction, and a plurality of contact parts each having at least one first contact section for making contact with one of the two contact pieces, at least one second contact section for making contact with the other of the two contact pieces, and also having at least one fastening section for fastening the contact part to a fastening spot at the carrier strip, and wherein the contact element abuts, by way of first contact sections thereof, against the first contact piece and, by way of the second contact sections, against the second contact piece.

25. The arrangement according to claim 24, wherein the first contact piece is a socket part that extends around a center axis and the second contact piece is a pin part that extends around the center axis, wherein the carrier strip extends around the center axis, and wherein the longitudinal direction is situated transverse in relation to the center axis and extends around said center axis, and/or wherein the contact parts can be brought into contact with the first contact piece by way of the respective first contact sections, and that the contact parts are in contact with the second contact piece by way of the respective second contact sections, wherein the distance between opposing contact sections is increased in the event of a contact movement.

* * * * *